US010722772B2

(12) United States Patent
Edwards et al.

(10) Patent No.: US 10,722,772 B2
(45) Date of Patent: Jul. 28, 2020

(54) GARAGE SPORTS NET SYSTEM

(71) Applicant: GOHITTHEWALL, LLC, West Linn, OR (US)

(72) Inventors: Tara Edwards, West Linn, OR (US); Nathan Oldham, Spanish Fork, UT (US)

(73) Assignee: GOHITTHEWALL, LLC, West Linn, OR (US)

( * ) Notice: Subject to any disclaimer, the term of this patent is extended or adjusted under 35 U.S.C. 154(b) by 169 days.

(21) Appl. No.: 15/194,165

(22) Filed: Jun. 27, 2016

(65) Prior Publication Data

US 2016/0375332 A1 Dec. 29, 2016

Related U.S. Application Data

(60) Provisional application No. 62/300,468, filed on Feb. 26, 2016, provisional application No. 62/185,448, filed on Jun. 26, 2015.

(51) Int. Cl.
*A63B 63/00* (2006.01)
*A63B 69/00* (2006.01)

(52) U.S. Cl.
CPC ..... *A63B 63/004* (2013.01); *A63B 69/0097* (2013.01); *A63B 2063/006* (2013.01); *A63B 2210/58* (2013.01)

(58) Field of Classification Search
CPC ..... E05D 15/36; E05D 15/28; A63B 63/004; A63B 2063/006; A63B 69/0097
USPC ..... 473/476, 490, 465, 172, 190, 191, 197, 473/421
See application file for complete search history.

(56) References Cited

U.S. PATENT DOCUMENTS 2,264,127 A * 11/1941 Thorstein ..... A63B 63/00 273/381
3,021,896 A * 2/1962 Buono ..... E05D 15/24 160/113
3,456,945 A * 7/1969 Epply ..... A63B 69/0097 473/435
3,672,672 A * 6/1972 Rubin ..... A63B 69/0097 473/435
4,183,524 A * 1/1980 Kifferstein ..... A63B 63/00 473/197
5,807,193 A * 9/1998 Talarico ..... A63B 69/0097 473/421
5,830,089 A * 11/1998 Halter ..... A63B 63/004 473/478
10,166,453 B1 * 1/2019 Dickerson ..... A63B 69/0097
2013/0252766 A1 * 9/2013 Nelson ..... A63B 61/00 473/422

(Continued)

*Primary Examiner* — John E Simms, Jr.
*Assistant Examiner* — Rayshun K Peng
(74) *Attorney, Agent, or Firm* — Miller Nash Graham & Dunn LLP

(57) ABSTRACT

A sports net system has a frame attached to rails of a garage door, the frame having vertical tubes, a sports net attached to the frame, and an angling attachment attached to the frame, the angling attachment to allow the frame to tilt relative to the rails of the garage door. A sports net system has ground-mountable support rails having vertical slots, a frame having vertical tubes that fit within the vertical slots, a sports net attached to the frame, and an angling attachment attached to the frame, the angling attachment to allow the frame to tilt relative to the support rails.

13 Claims, 36 Drawing Sheets

(56) References Cited

U.S. PATENT DOCUMENTS

2014/0094327 A1* 4/2014 Freund ..... A63B 69/0097
473/435

* cited by examiner

GARAGE SPORTS NET SYSTEM

RELATED APPLICATIONS

This application is a continuation of, and claims priority to, U.S. Provisional Patent Applications 62/185,448, filed Jun. 26, 2015; and 62/300,468, filed Feb. 26, 2016, both of which are incorporated herein by reference in their entirety.

TECHNICAL FIELD

This disclosure relates to sports net systems, more particularly to sports net systems usable with garage openings or mounted to the ground with a tiltable net.

BACKGROUND

Many parents have sat in their houses and heard the sound of a ball banging off the garage door as their kids practice whatever sport they want, including soccer, basketball, lacrosse, etc. This is generally followed by a parent running out to ask the child to stop, the parent hoping to stop the garage doors from getting damaged from the impact of the balls. As a practice aid, some people use rebounding systems, in which a net of some kind, that has some elasticity, rebounds the ball to the player. Some people use a specialized sports goal in which a net absorbs the impact of a ball being thrown towards the target. Some rebounding systems and personal sized sports goals utilize a target for accuracy practice. These systems are generally freestanding frames with some sort of support, to which the net is laced or mounted to the frame. These systems can take up quite a bit of space and are not easily stored.

It would be beneficial if one could combine the ability to employ these types of systems with the convenience of a garage door. It would also be beneficial if these systems could be used from both the inside and the outside of the garage door for year round use, regardless of the weather. It would also be beneficial if these systems could have different nets available for different sports applications.

BRIEF DESCRIPTION OF THE DRAWINGS

FIGS. 7-15 show another embodiment of an angling attachment.

FIG. 28 shows an embodiment of a garage sports net system in a deployed position and angled in.

DETAILED DESCRIPTION OF THE EMBODIMENTS

Figure 1:
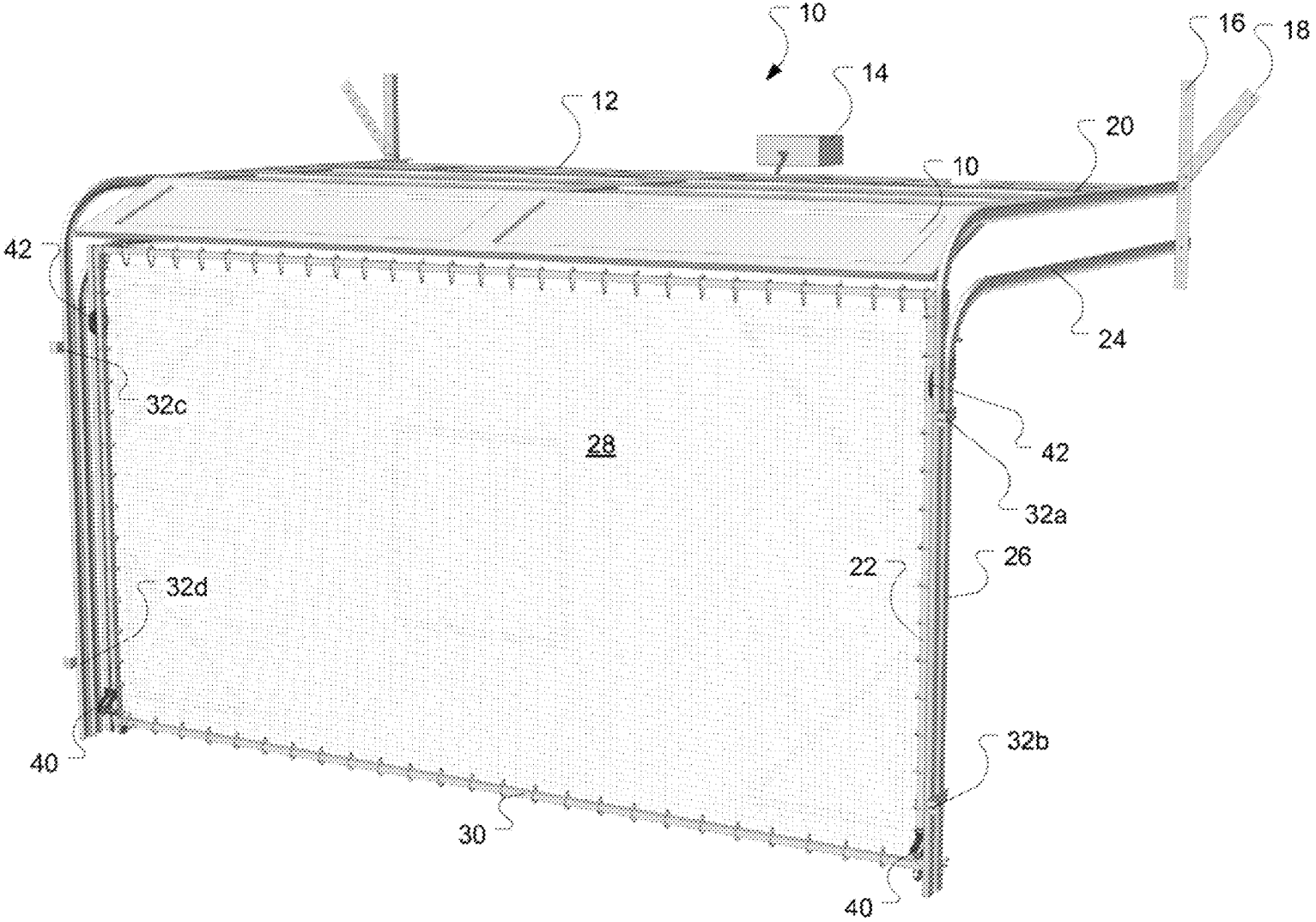
FIG. 1 shows an outer view of a garage sports net system.

FIG. 1 shows an outer view of a garage net system 10. In this discussion, the terms outer and inner mean the inside or outside of a garage. The system 10 allows the user to install the sport net system in their garage without interfering with the garage door when the sports net system is in the stowed, or up, position. Garage door 12 is installed and has horizontal rail with one curved end 20 and vertical rail 22. Typically, these rails are installed as two pieces. The horizontal rails hang from the ceiling of the garage by angle brackets 16 and 18. The vertical rails are typically mounted to the wall of the garage by rail brackets and flag brackets (not shown).

The garage door opener 14 pulls and pushes the garage door 12 up and down the vertical rails 22 and horizontal rails 20 to open and close the door. The net system moves up and down parallel to the garage door in horizontal rails 24 and vertical rails 26, typically by adjustable roller mounts discussed in more detail later. The brackets 32*a-d* attach the garage sports net system rails 24 and 26 to the garage wall. The adjustable roller mounts for the garage sports net system actually roll in a vertical 26 and horizontal 24 rails specifically used for the garage sports net system. In this position, referred to here as the deployed position, the user can kick, throw, or hit balls, pucks or other projectiles into the net, and the net will cause the projectile to bounce back to the user. As will be discussed in more detail later, the tilt pivots 42 and the locking tilt pivot 40 in this embodiment allow the net to be angled.

Figure 2:
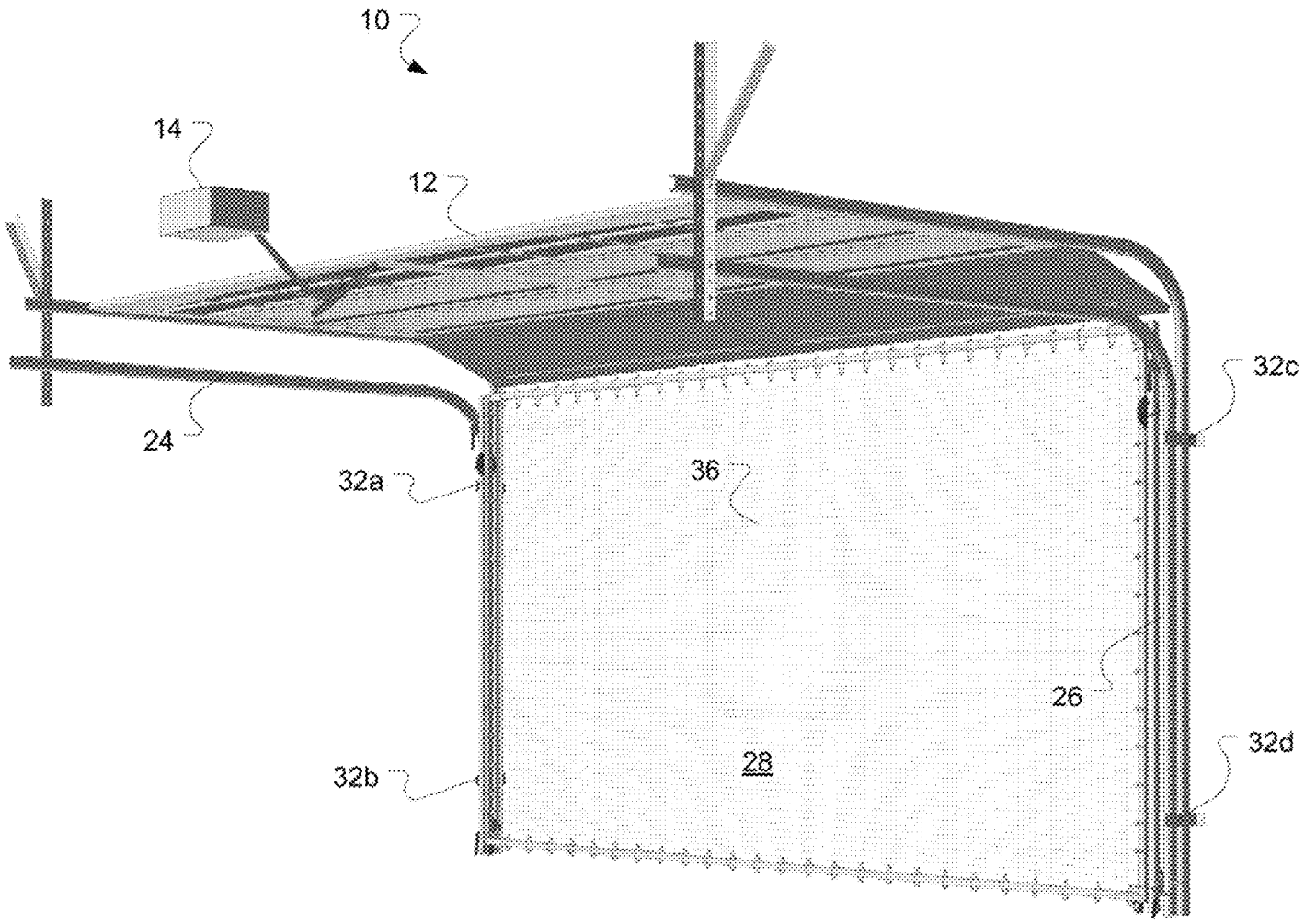
FIG. 2 shows an inner view of a garage sports net system.

FIG. 2 shows an inner view of a garage net system. From this view, one has a clearer view of the net systems vertical rail 26 mated with the garage door vertical rail 22. In one embodiment, the net system vertical rail 26 piggybacks next to the garage door vertical rail 22. The vertical rails 26 for the garage sports net system are attached to the wall with rail brackets 32*a-d* independent of the garage door. The garage door rail brackets are not shown in this diagram.

In another embodiment, the user would have the opportunity to remove at least the vertical rail 22 of the garage door and replace the single garage rail 22 with a double rail that accommodates both the garage door vertical rail and the net system vertical rail. In one embodiment only the vertical rails would be replaced. In an alternative embodiment, both the horizontal 20 and vertical rails 22 would be replaced. This 'married' rail configuration would have the two rails sharing the 'back' portion of the rails and having a common divider to define the two rails. In the piggybacked rails, each rail has its own back wall and each have their own edges, even though two of those edges are mated to align the rails together.

Figure 3:
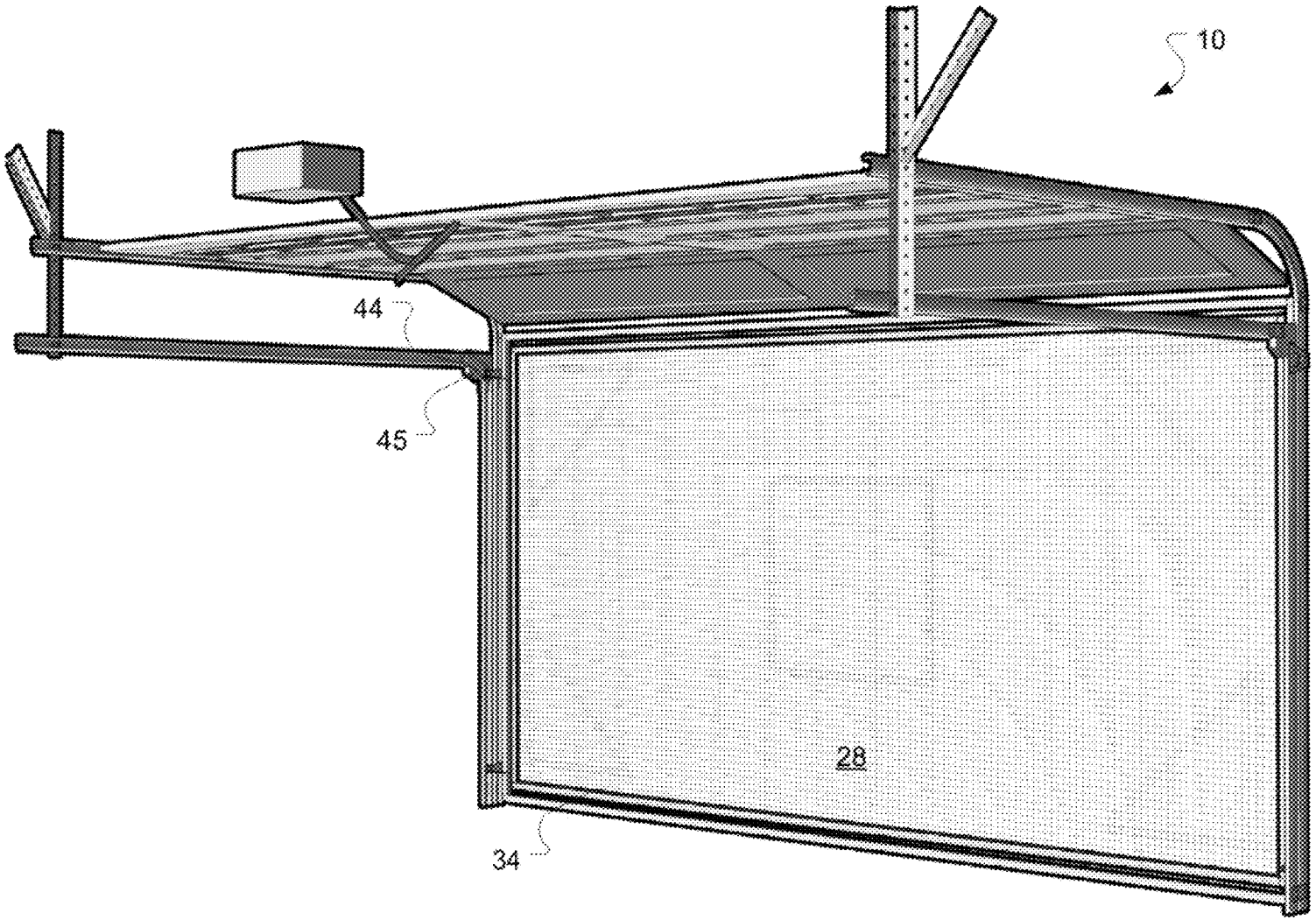
FIG. 3 shows an inner view of an alternative embodiment of a garage sports net system.
Figure 4:
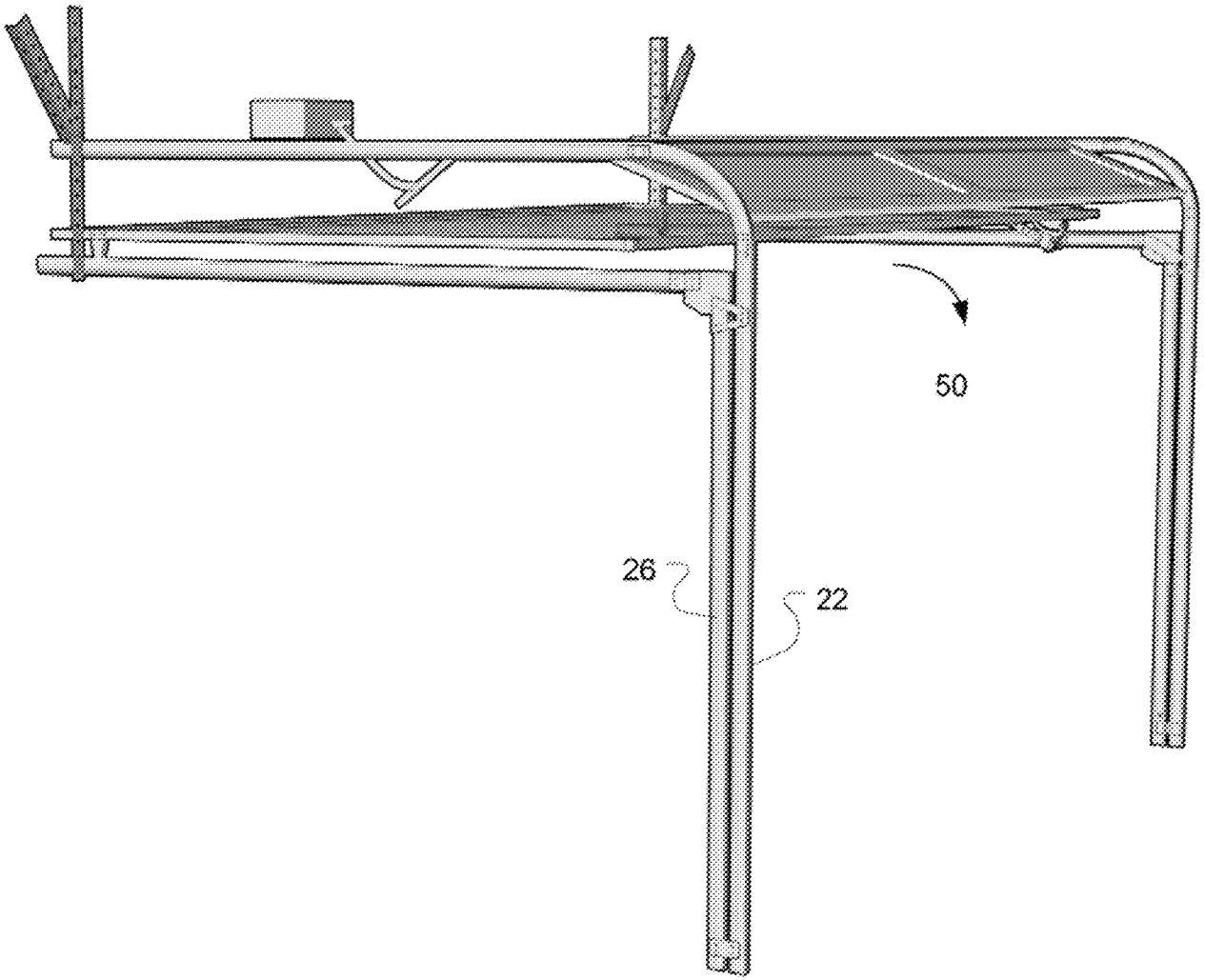
FIGS. 4-5 show a side view of a garage sports net system during deployment.
Figure 5:
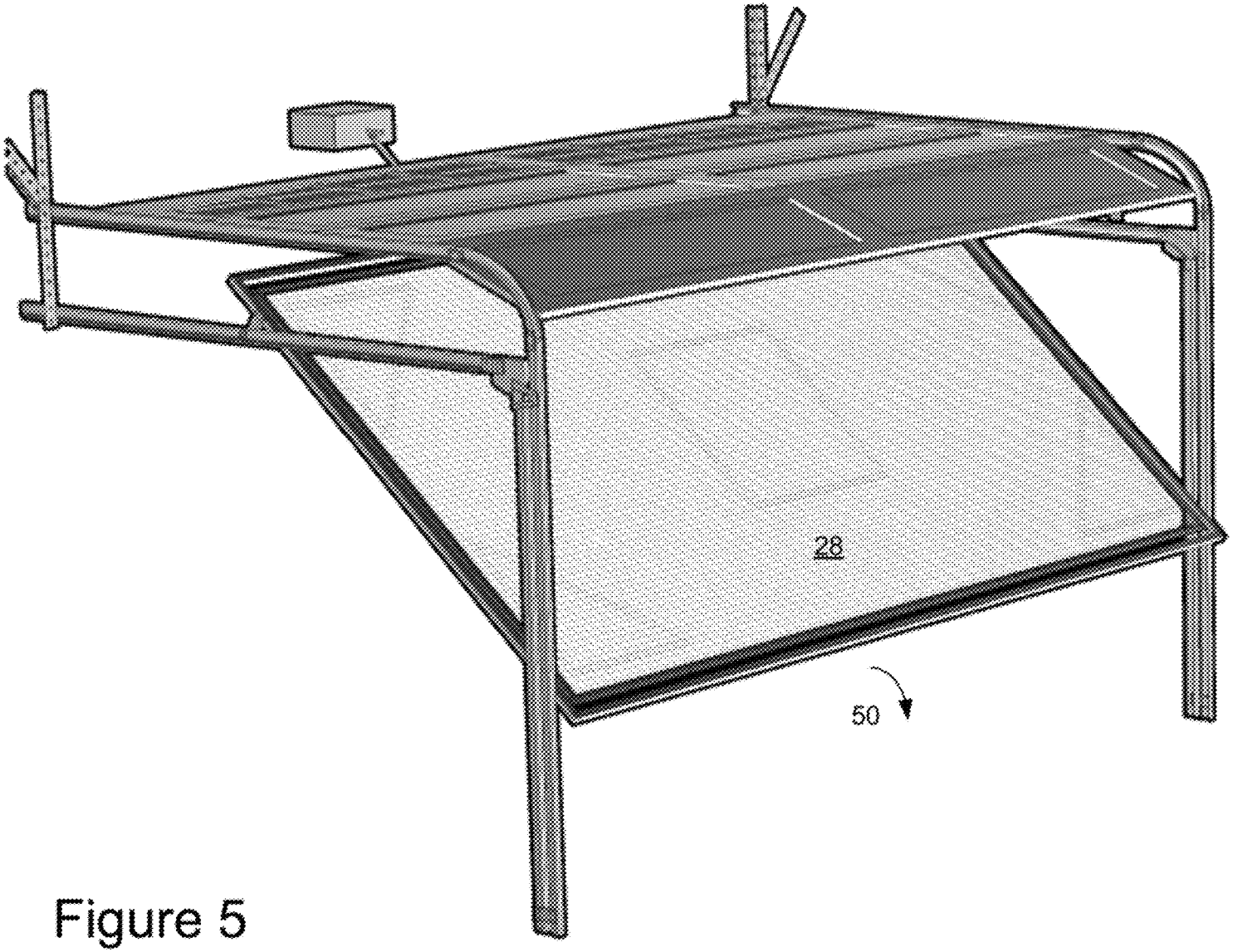
Figure 6:
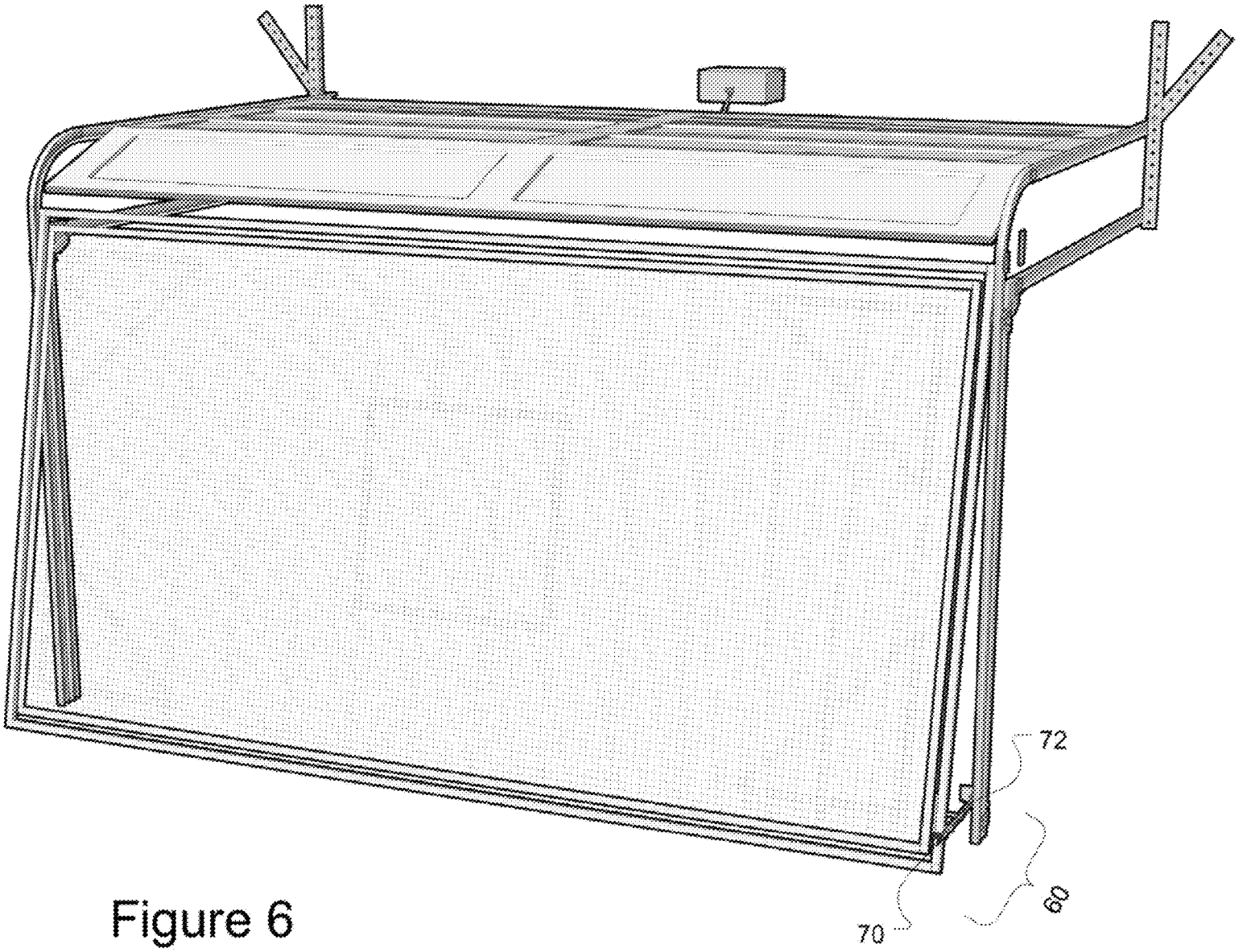
FIGS. 6-8 show one embodiment of an angling attachment.

FIG. 3 shows an alternative embodiment of a garage sports net system 10. In this embodiment, the pivots at the top corners of the net 28 are replaced with compact radial turn pieces 45 through which the wheels such as 44 traverse as the net moves into the deployed system. In this embodiment, the net 28 is mounted in a net-in-a-frame, with 34 being the frame. FIG. 3 shows a compact radial turn. FIGS. 4 and 5 also show the compact radial turn. FIG. 6 shows an angling attachment as well as the compact radial turn.

FIGS. 4 and 5 show the net as it deploys into its system for use. In FIG. 4, the net is in its stowed or undeployed position. The net will deploy down along rail 26 in the direction of arrow 50. FIG. 5 shows the net system as it reaches its deployed position.

Figure 7:
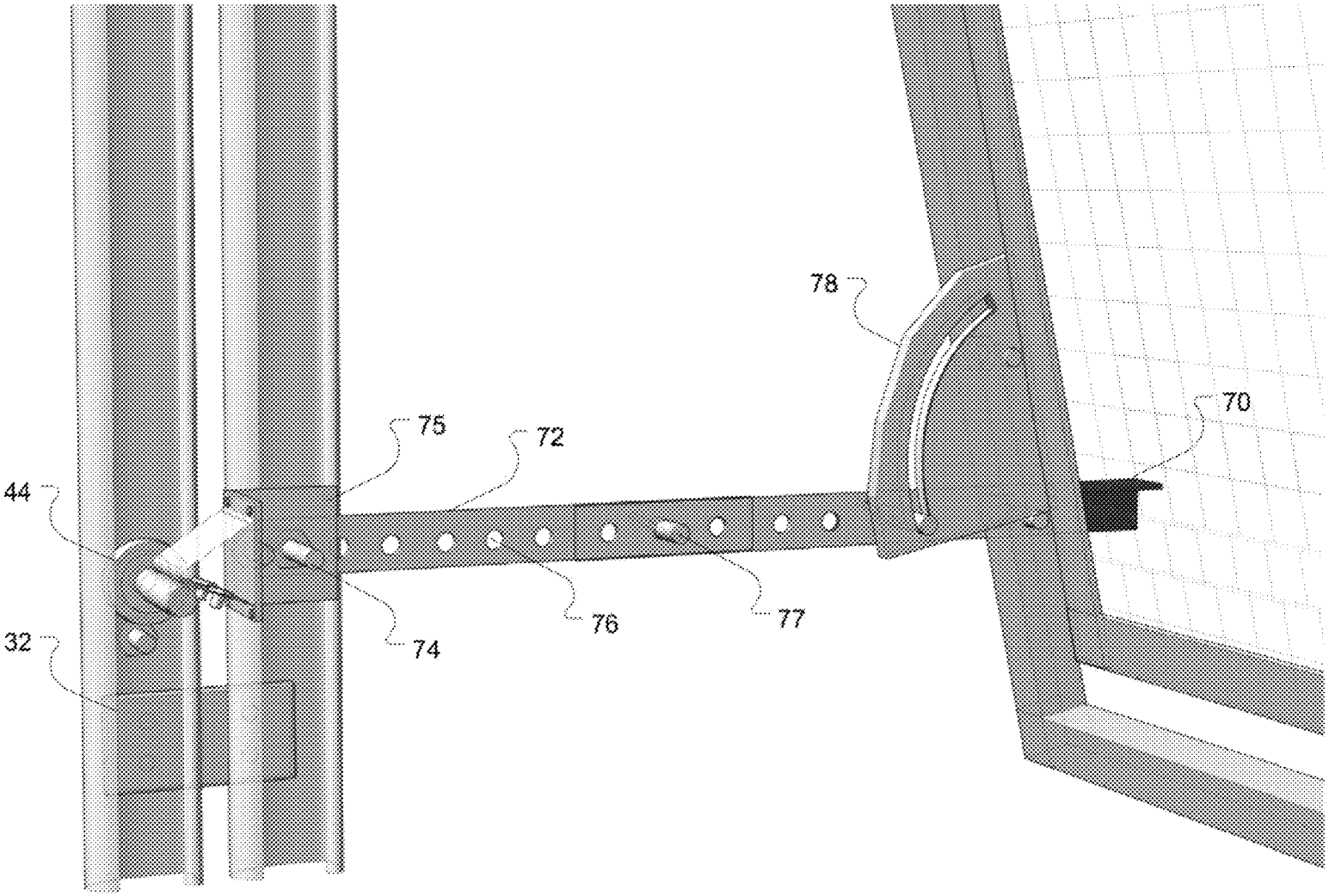
Figure 8:
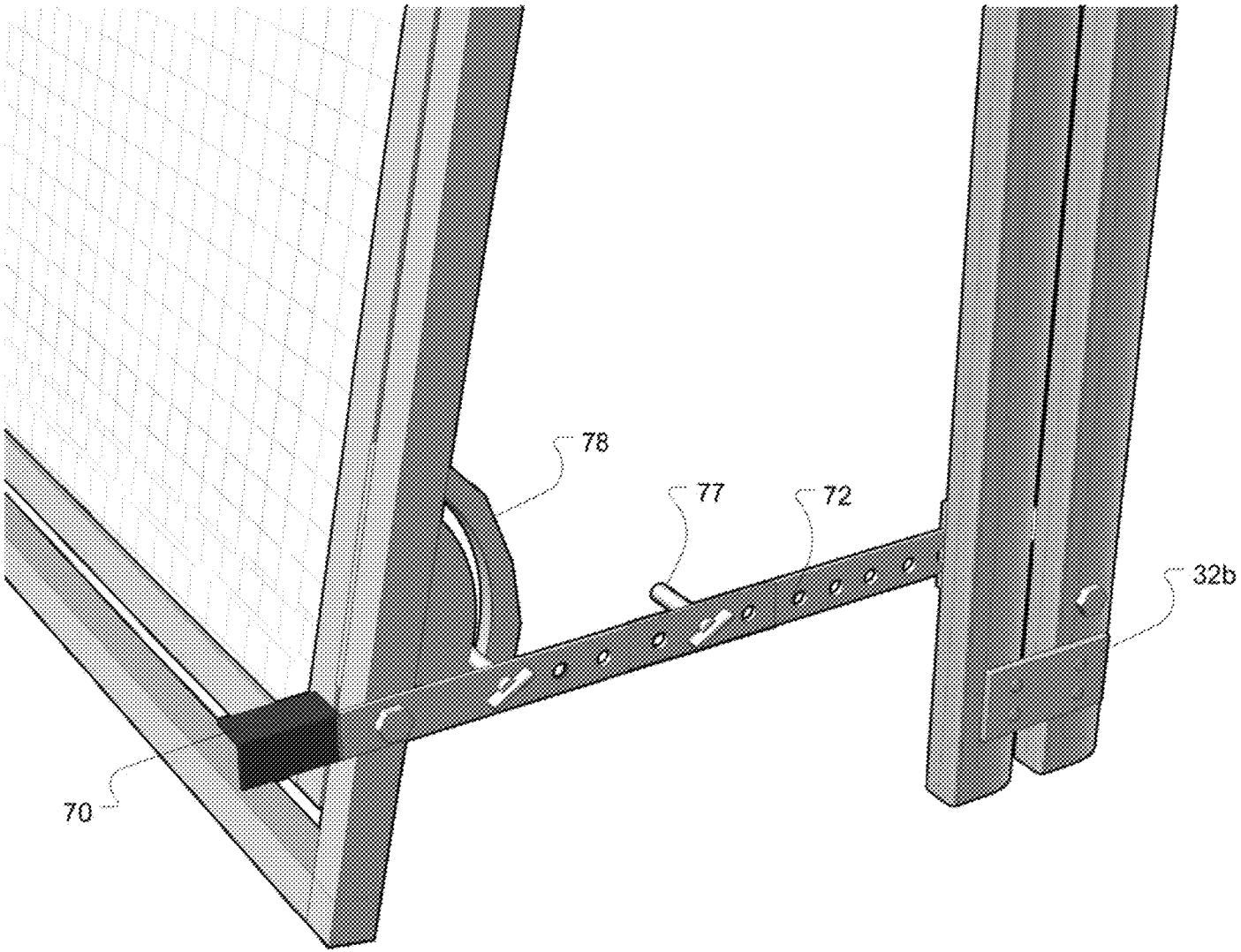

FIGS. 6-8 show one embodiment 60 of an angling attachment, which may be referred to as a kicker. In FIG. 6, the kicker 60 has been positioned to angle the bottom of the net. There is a handle 70 that allows the user to move it using his or her foot, and an arm 72 that has different positions.

FIGS. 7 and 8 shows a more detailed view of the kicker. The net system moves along the rails with a wheel 44. The wheel attaches to the net system with a bracket 75, having a fastener of some sort 74. The angling attachment arm 72 has holes such as 76 that allow the distance of the net from the rail. A pin 77 allows the net side of the angling attachment to connect to the rail side of the attachment. The angling arm is positioned by traversing the slot in the angling plate 78, with the handle 70 allowing the user to 'activate' the angling attachment to pull the bottom of the net out. During movement of the net in the rails, the kicker is folded up so the net is straight up and down.

In this embodiment, the kicker attaches to the net system frame 30 from FIG. 1 with a fastener that allows it to slide. As shown in FIG. 8, the back of the kicker 72 attaches to the lower wheels of the garage door. This allows the kicker to remain out of the way when stowed and in motion. This will be discussed in more detail further. The kicker has a small protruding portion or handle 70 that allows it to be kicked into place by a user's foot. A kicker will reside on either side of the bottom of the frame, although only one is shown here for simplicity. The frame pivots on the axels of its wheels at the upper bracket 48, so no extra or different fastener is needed. More detailed discussions of the pivot mechanism and other implementations of the kicker will be discussed further.

Figure 9:
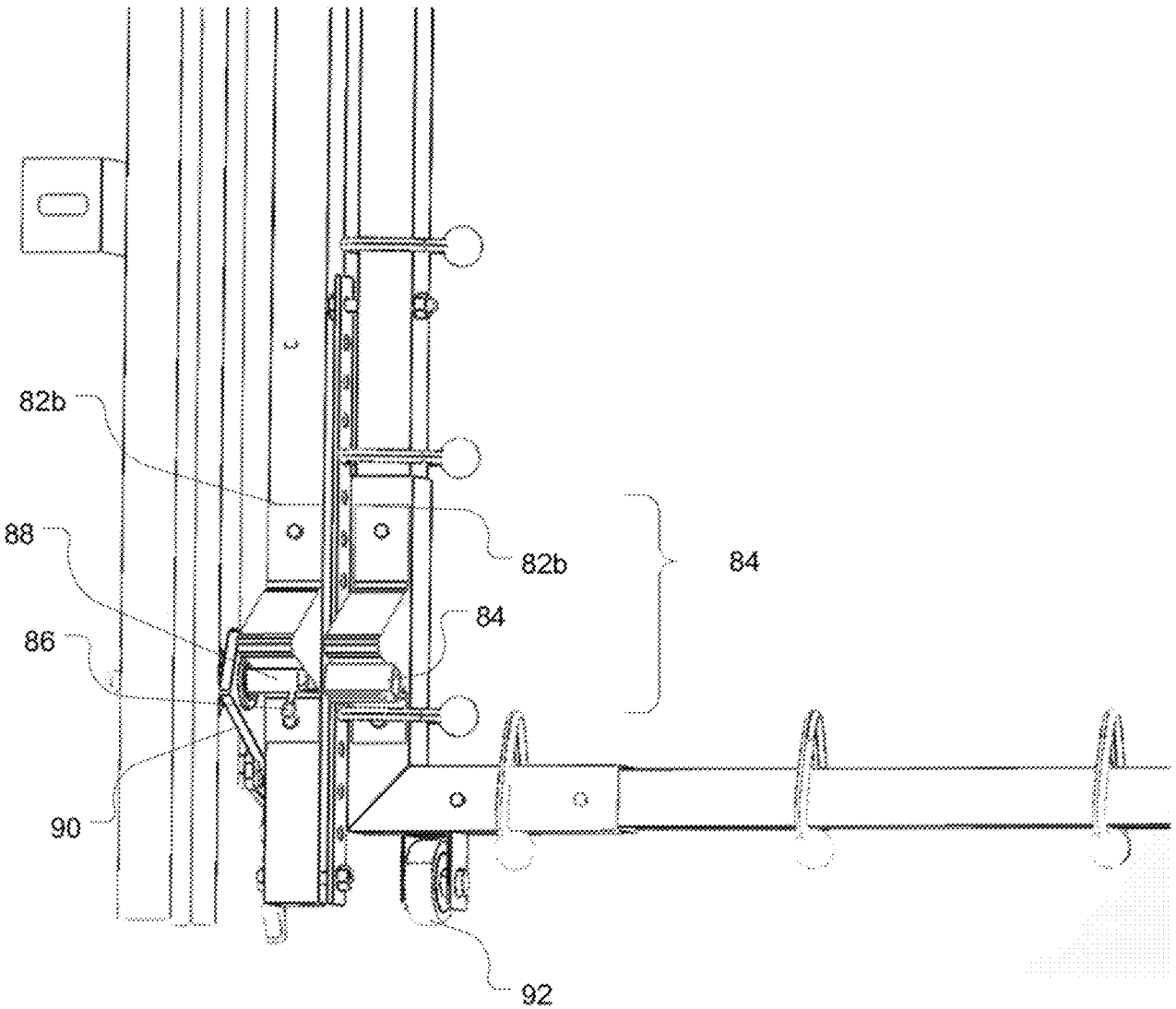
Figure 10:
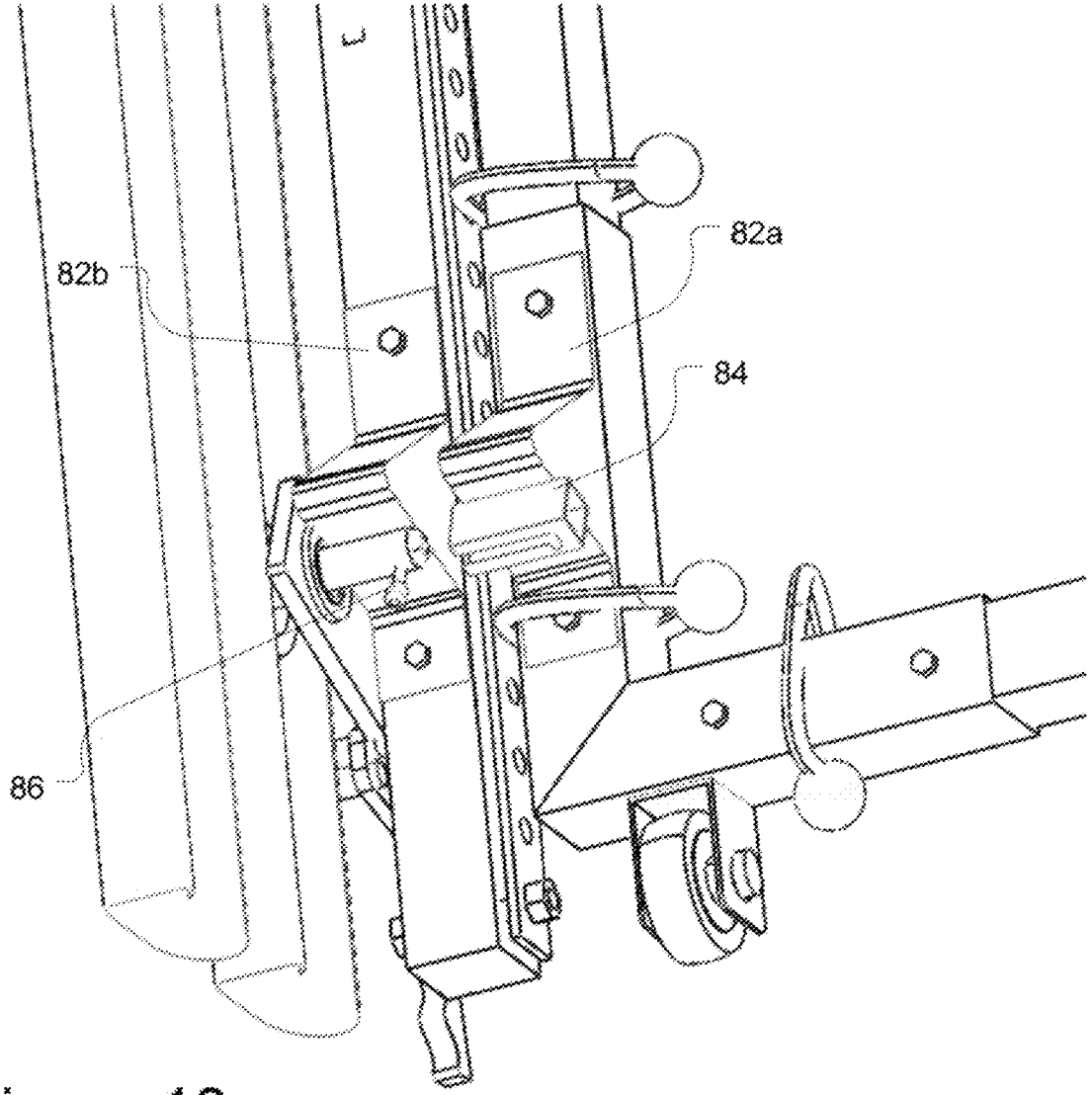

Another embodiment 80 of the angling attachment or kicker is shown in FIGS. 9-15. In FIGS. 9-10, one can see the net side of the kicker having a net wheel 92 that allows the net to move easily into an angled position. On the net side of the angling attachment, there is a bracket 82*a*, against which rests the pin retaining bracket 84. The rail side of the attachment has a bracket 82*b* under which lies the bracing plate 90. The locking pin 88 has a handle portion 86 that allows the user to move the pin to release it and allow it to slide to the left towards the bracing plate 90.

Figure 11:
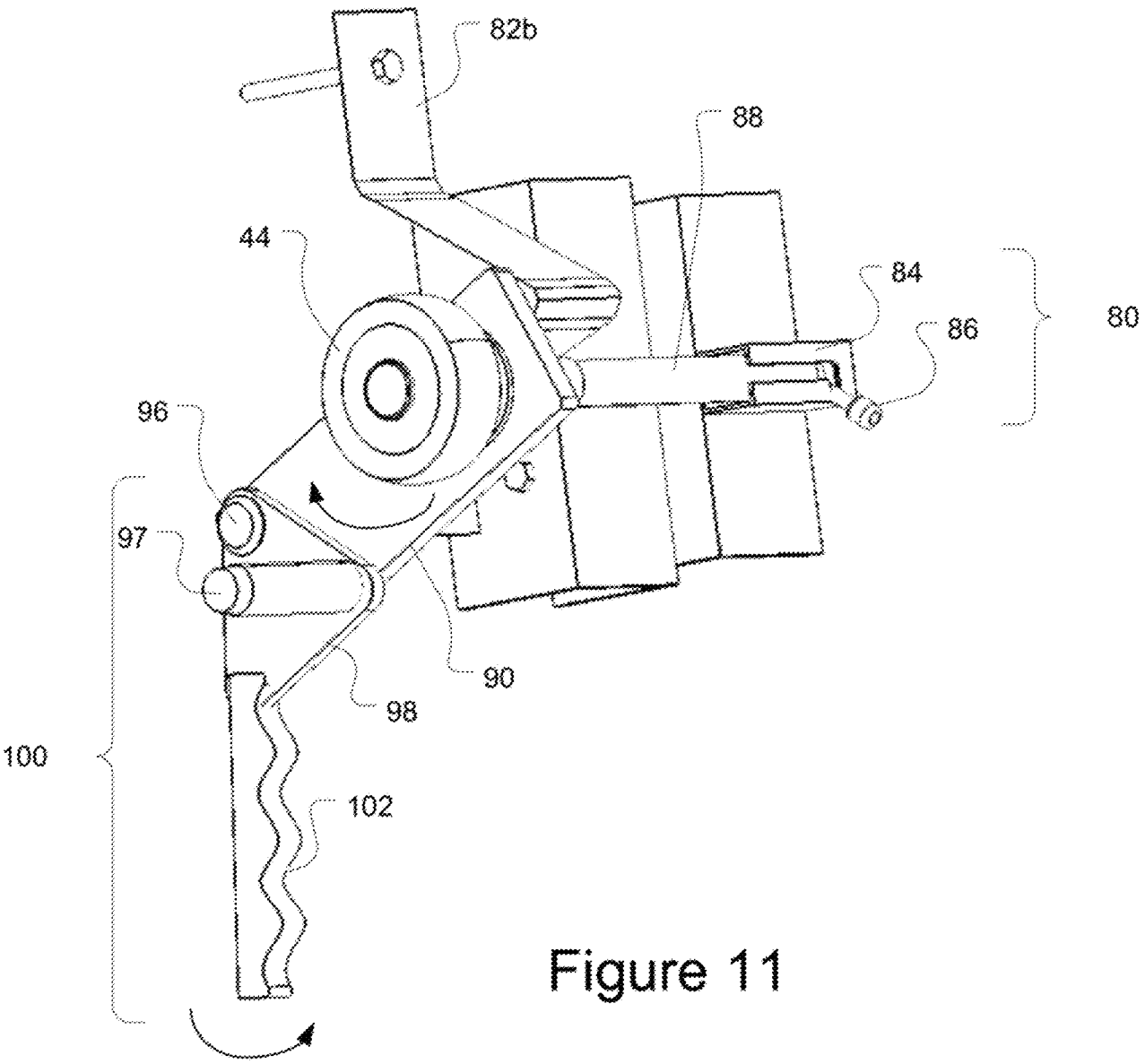
Figure 12:
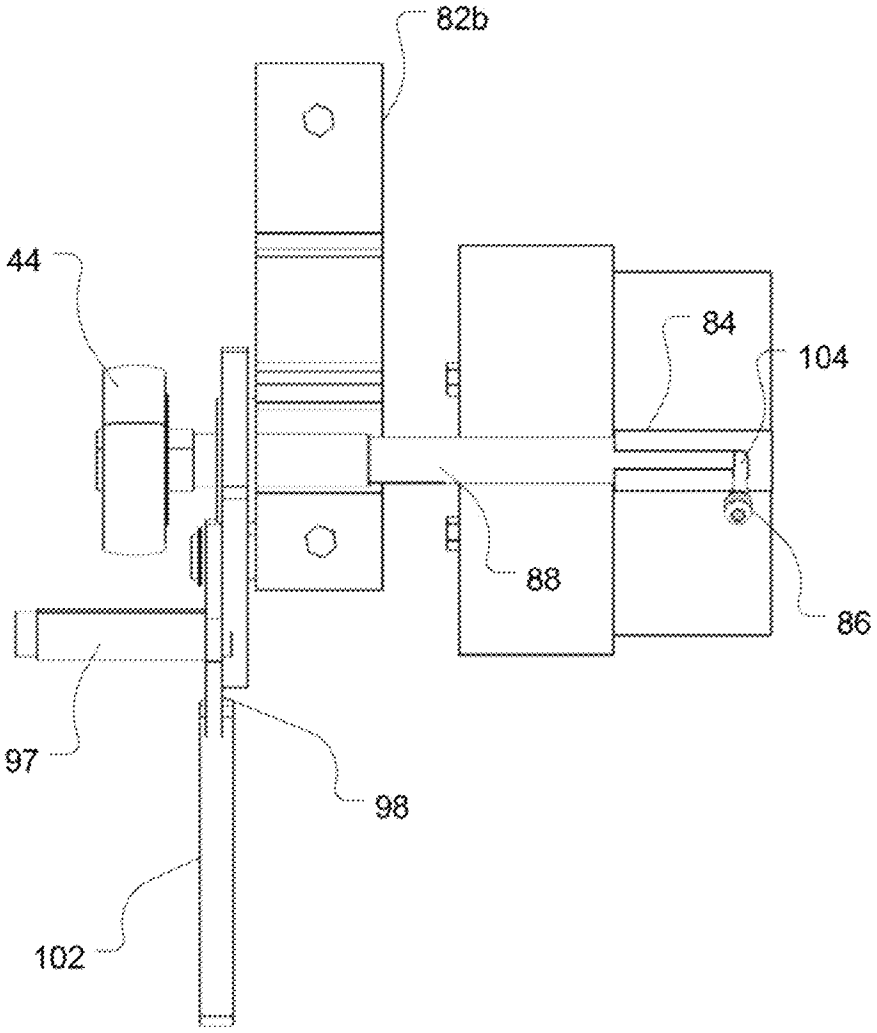
Figure 13:
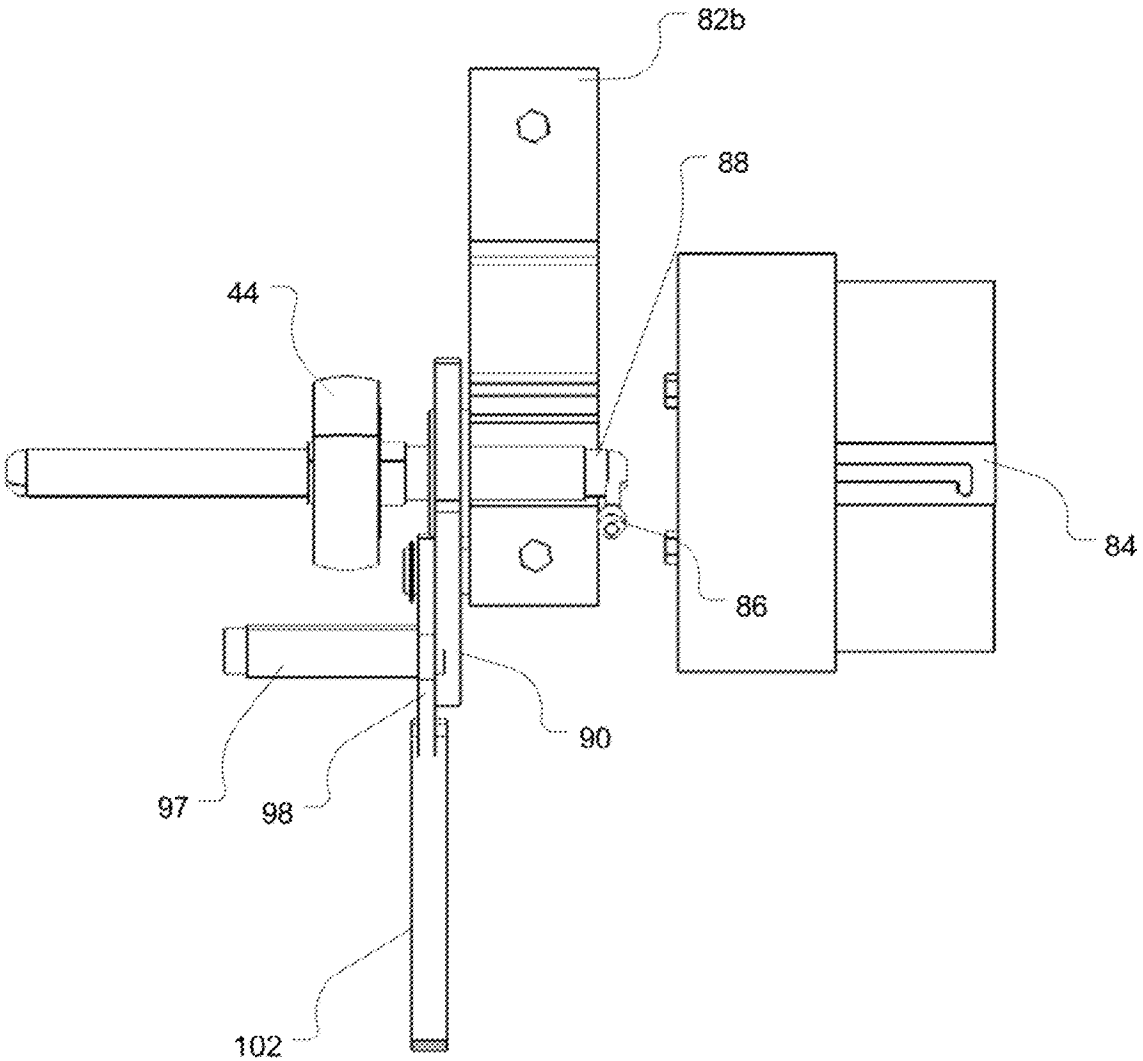
Figure 14:
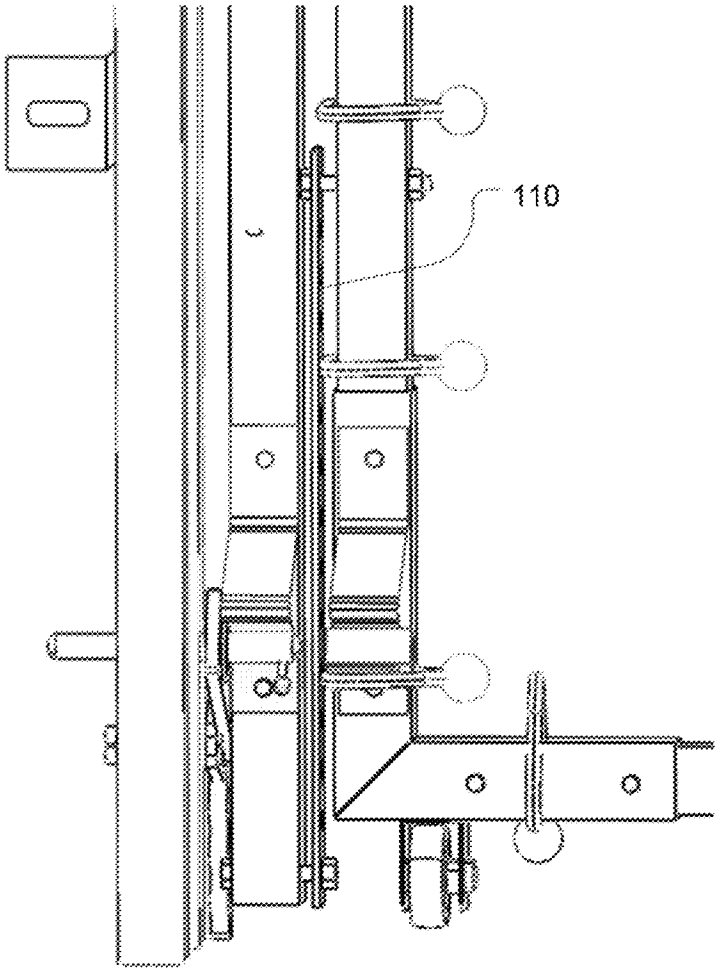
Figure 15:
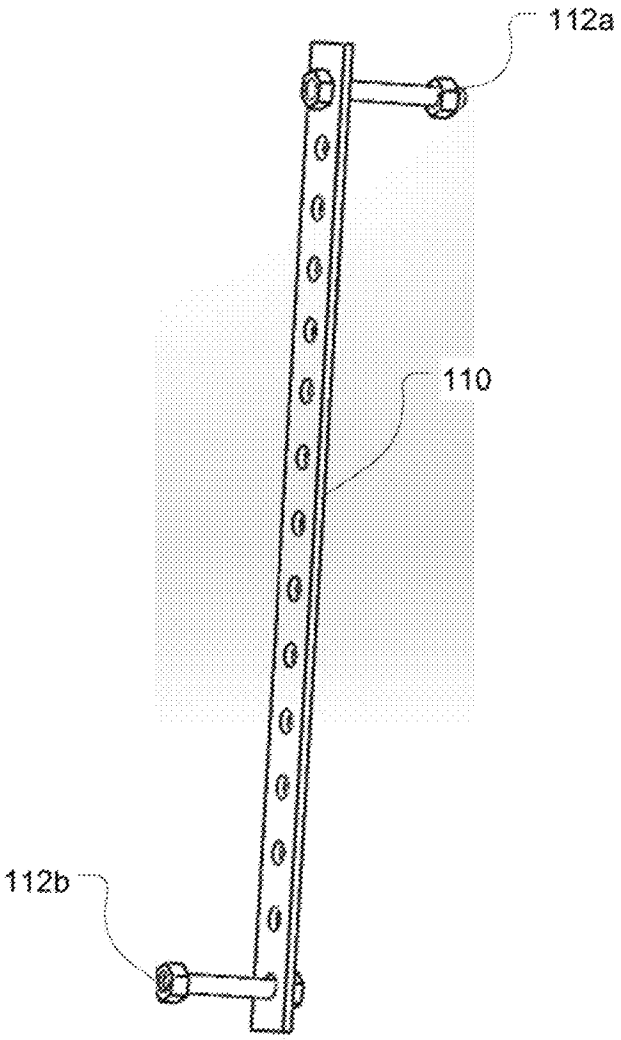

FIGS. 11-13 show a more detailed view of the angling attachment 80 and bracing clamp 100. The bracing clamp 100 is used on both sides of the bottom of the net with the angling attachments 80 and on the upper corners of the net with the pivots, as discussed in more detail further. The view of FIG. 11 shows the locking pin 88 it its locked position, with the handle 86 in a notch, seen in more detail later, of the locking pin retaining bracket 84. This holds the net tightly to the wheel 44 and its attachment, making the mechanical connection more solid. The wheel has the locking pin 88 as its hub, and the locking pin passes through the bracing plate 90. The bracing plate 90 attached to the clamp body 98 by a pin or other fastener 96. The clamp body has a bracing clamp pin 97 and a handle 102. The bracing plate 90 moves in the direction of the arrow shown and the handle 102 moves in the opposite direction.

FIG. 12 shows a different view of the kicker. In this view, the handle 86 has been moved from out of the retaining pin notch 104 which frees the locking pin to move towards the left. FIG. 13 shows a view in which the pin 88 has been pulled out of the pin retaining bracket 84, separating the net side from the rail side completely in this area. The user disconnects the other side and rolls the net out using wheel, which are optional. The net remains connected to the frame by a kicker arm 110, shown in place in FIG. 14 and by itself in FIG. 15. The kicker arm 110 attaches to the net and the frame with the fasteners such as 112*a* and 112*b*.

Figure 16:
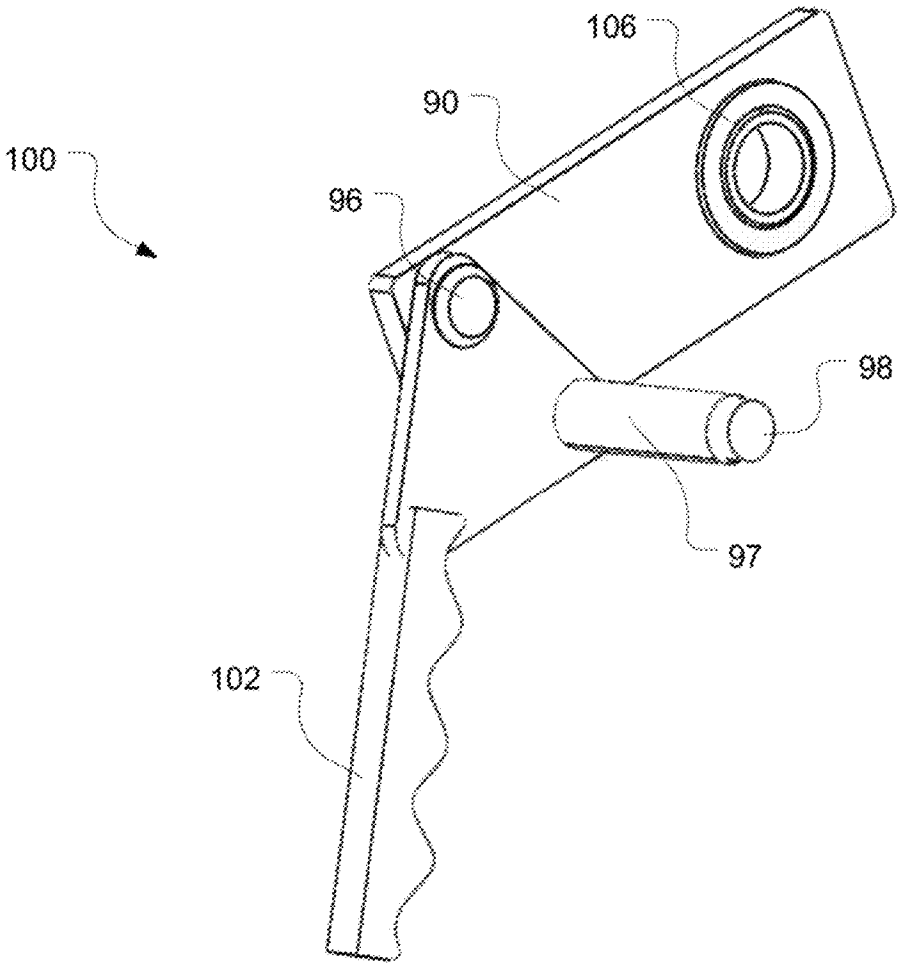
FIGS. 16-17 show an embodiment of a bracing clamp.
Figure 17:
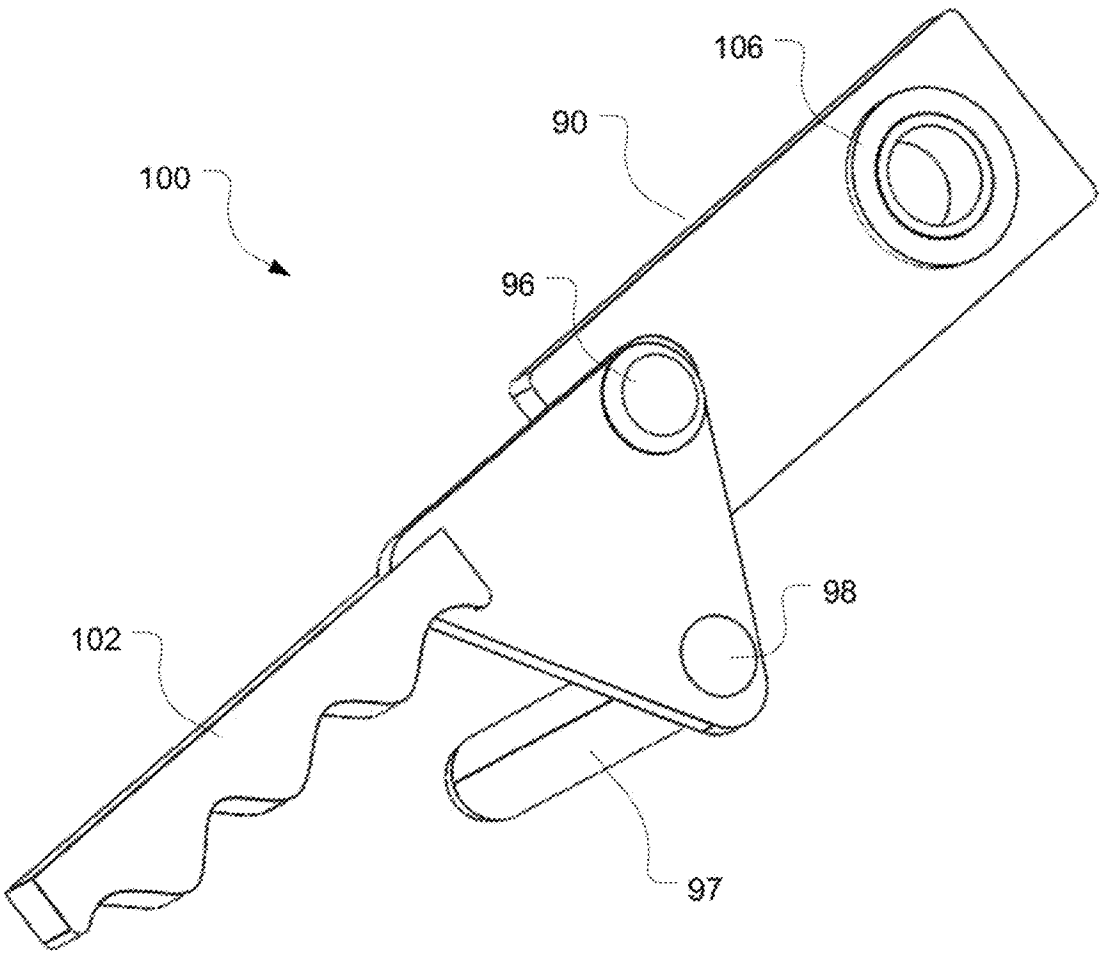

One aspect of this system that enables this type of angling attachment and a pivot that will be discussed later is the bracing clamp. The bracing clamp is shown in more detail in FIGS. 16 and 17. The bracing clamp 100 has a handle 102, a pin 97, and a bracing pin 96 that attaches the bracing plate 90 to the clamp 98. Also seen in these views are the hole 106 through which the locking pin runs to the wheel, not shown.

The bracing clamp pivots about the plate 90 and has a pin 97. The bracing clamp handle 102 that is grasped and pulled down in the direction of the arrow. This causes the bracing clamp pin 97 mounted on the bracing plate 90 with a pivot pin 96 to press against the vertical rail 26. This forces the wheel to become snug to the rail wall in the direction of the arrow shown on the rectangular plate 90. This assists with absorption of the impact of the various projectiles on the frame.

Figure 18:
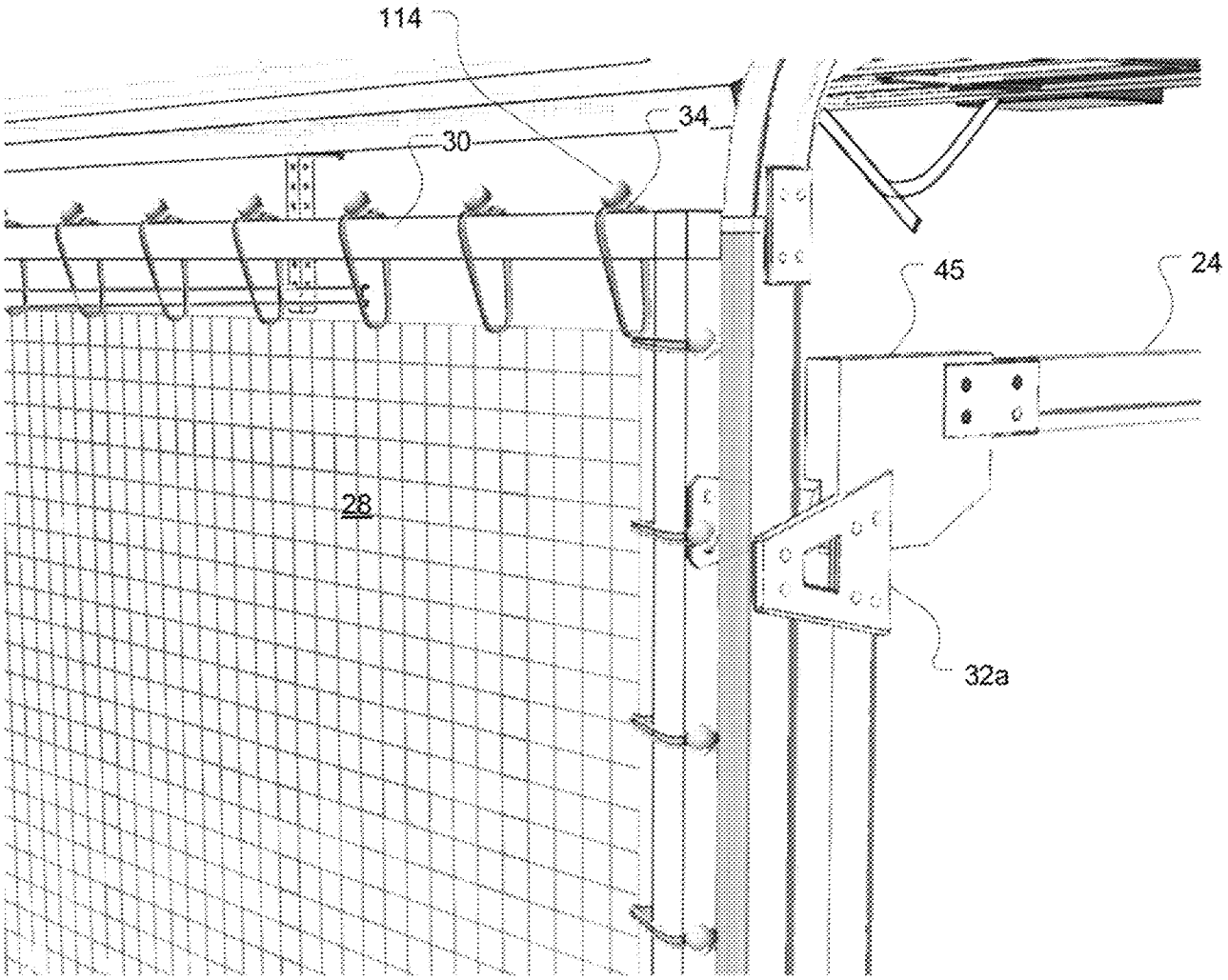
FIG. 18 shows an embodiment of an upper corner of the garage sports net system.

As discussed above, the bracing clamp resides in all four corners of the net, when the angling attachment 80 and the pivot 40 are used. For the embodiment that uses a net in a frame, the bracing clamp is not used. For that embodiment, the upper corners of the net appear as in the embodiment of FIG. 18. In the net in a frame embodiment, the brackets such as 32*a* are the same, but the horizontal rail 24 has a compact radial turn piece that allows the garage net system to move in its rails without hitting the garage door. The net attaches to the frame 34 with bungee cords such as 30. The cords have a loop that accepts a connecting ball 112 that keeps the bungee in place, ultimately keeping the net in place.

Figure 19:
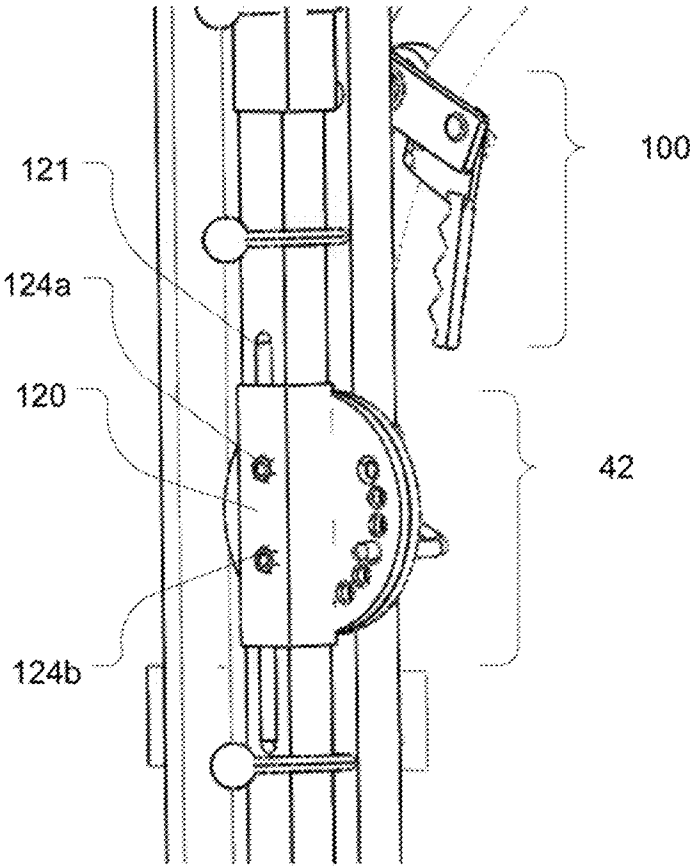
FIGS. 19-22 show an embodiment of a pivot mounted to an upper corner of the garage sports net system.
Figure 20:
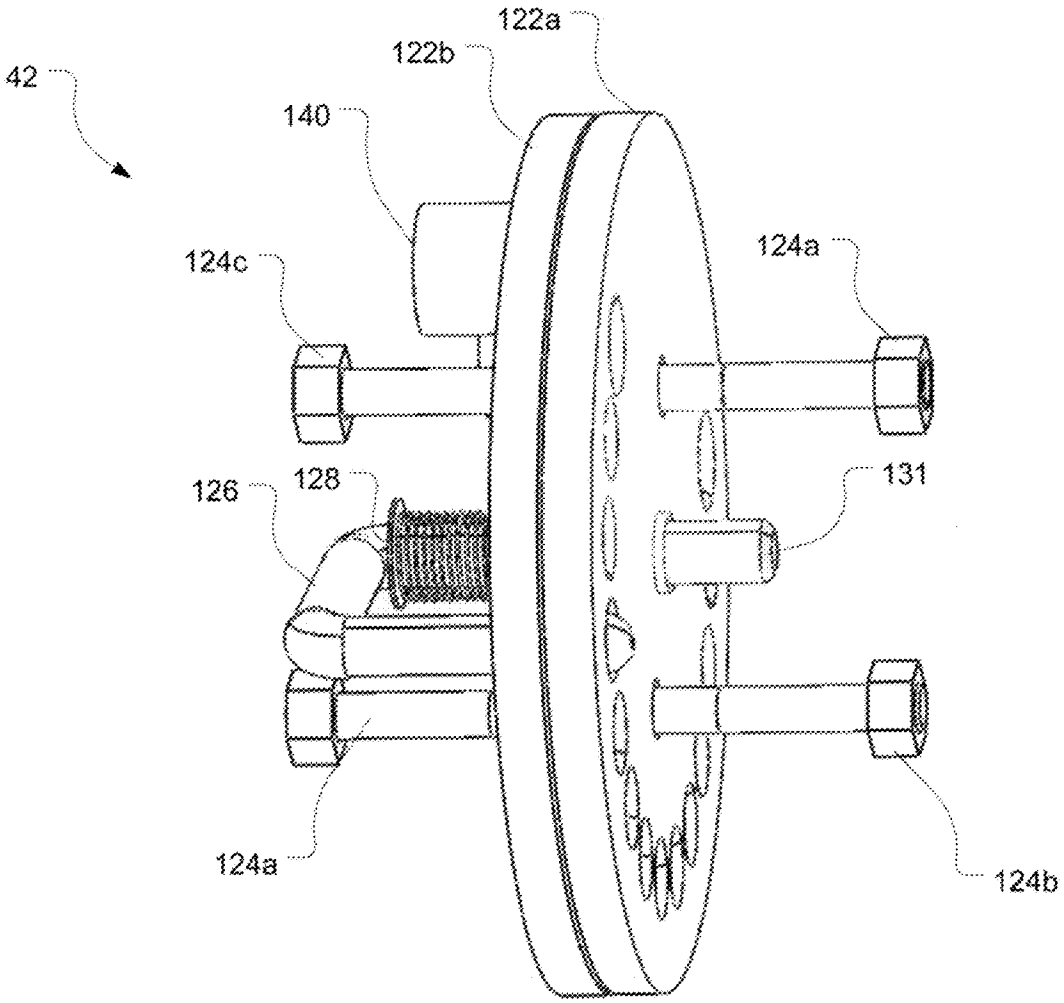
Figure 21:
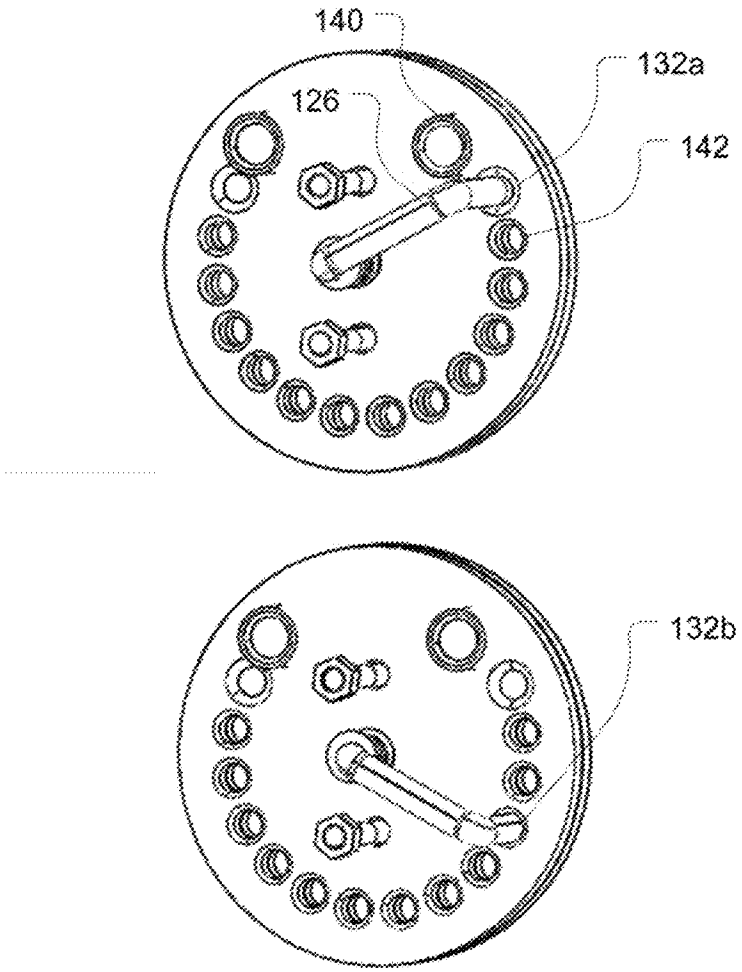
Figure 22:
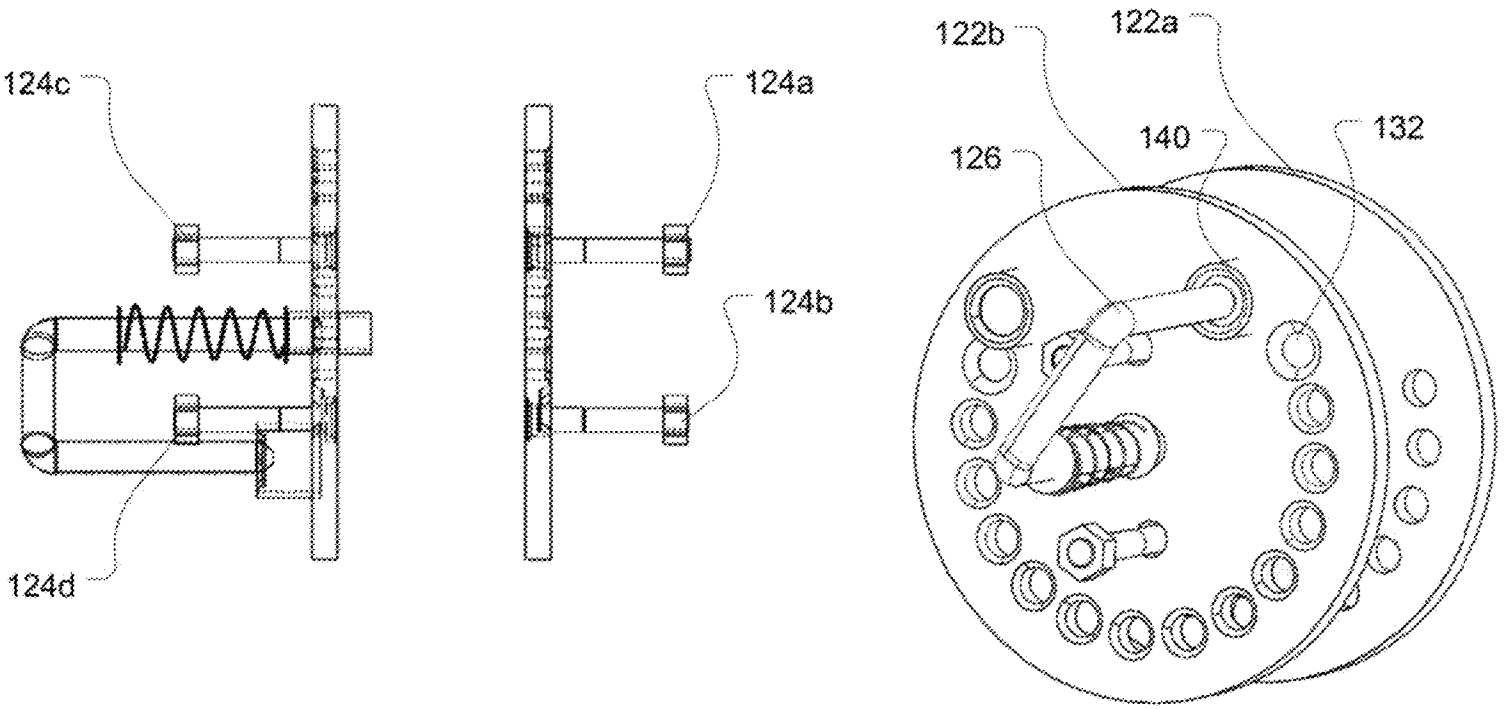

The bungees and balls may be used in the embodiment employing a pivot as well. FIG. 19 shows an embodiment using a pivot 42 and a bracing clamp 100. The pivot 40 attaches to a sleeve 120 using fasteners such as 124*a* and 124*b*. The sleeve 120 travels up and down a slot 121 as needed to move the net frame. FIGS. 20-22 show more detailed views of an embodiment of a pivot 40.

The pivot 40 has two pieces, 122*a* being the side without the handle, and 122*b* the side with the handle. The fasteners previously mentioned are 124*a-d*. The handle 126 mounts to the side of the pivot 122*b* having the handle with a spring 128. The handle 126 has two ends that can be seen through the side 122*a* without the handle. The first side 131 may be referred to as the mounted end 131 with the other end being referred to as the insertion end 130.

As shown in FIG. 21, the handle may take one of several positions with the insertion end. When the user pulls the handle out, he or she can move the insertion end and put in into one of the positional holes such as 142. It may also be 'rested' at position 114, which is a partial hole, but holds the insertion end away from making contact to the other side of the pivot. This allows the user to 'hold' the handle in a neutral position so he or she can move the pivot on the other side of the net to a new position. The user then returns to whichever pivot is in the neutral position and places it in the appropriate position.

FIG. 22 shows the handle in the disconnect position. The handle is moved to the disconnect stop position 116. This separates the handle from the other side of the pivot completely, thereby allowing the use to disconnect the net system completely. For example, the user may just want to remove the net system because he or she no longer wants to use it. Alternatively, the user may want to replace it with a different kind of net.

In addition to different types of attachments for the net, the net itself may consist of many different types. The discussion above has focused on rebound netting, typically made of a material with some elasticity that allows the projectile to bound back towards the user. The frame may be used for other types of sports nets, including 'impact' netting. Impact netting absorbs the impact of the incoming projectile, not returning the projectile to the user. This is most commonly seen in soccer goals. The ball travels into the net and the next is slack but absorbs the momentum of the ball, causing the ball to fall to the ground. Impact nets generally have a distance beyond the mounting points beyond which they extend. This may need to be considered when a user decides how much slack they want in the net, if vehicles are to be parked in the garage.

Many different alternatives for the net exist. Different targets may be painted on the net, or the net may be a combination of a solid sheet of material, akin to a tarp, having holes in it for targets. To stop the projectiles, an impact net may be mounted behind the tarp to stop the projectiles.

The discussion above assumes that the user will be outside the garage kicking, throwing or hitting the projectile towards the garage door opening. However, the user may be inside the garage. This may be more appropriate for impact netting so that projectile does not run the risk of causing any damage inside the garage. The overall frame system may be provided with multiple nets and attachments that allow the user to change the nets as desired. For example, a family may have one child that plays soccer and another that plays hockey. The soccer player may use rebound netting from the outside of the garage, and the hockey player may use impact netting from inside the garage. The family may have two children, both using the net at the same time, from opposite sides of the net, however if the ball hits at the same time, at the same place, the bounce will be affected.

Similarly, the targets on the net may include markings for just about any sport including soccer, baseball/softball, lacrosse, hockey, volleyball, tennis, squash, cricket, etc. If the user has a basketball hoop over the garage door, the kicker may be used to provide a ball return for a basketball shooter. The variations and adaptations are left up to the user's imagination.

Figure 23:
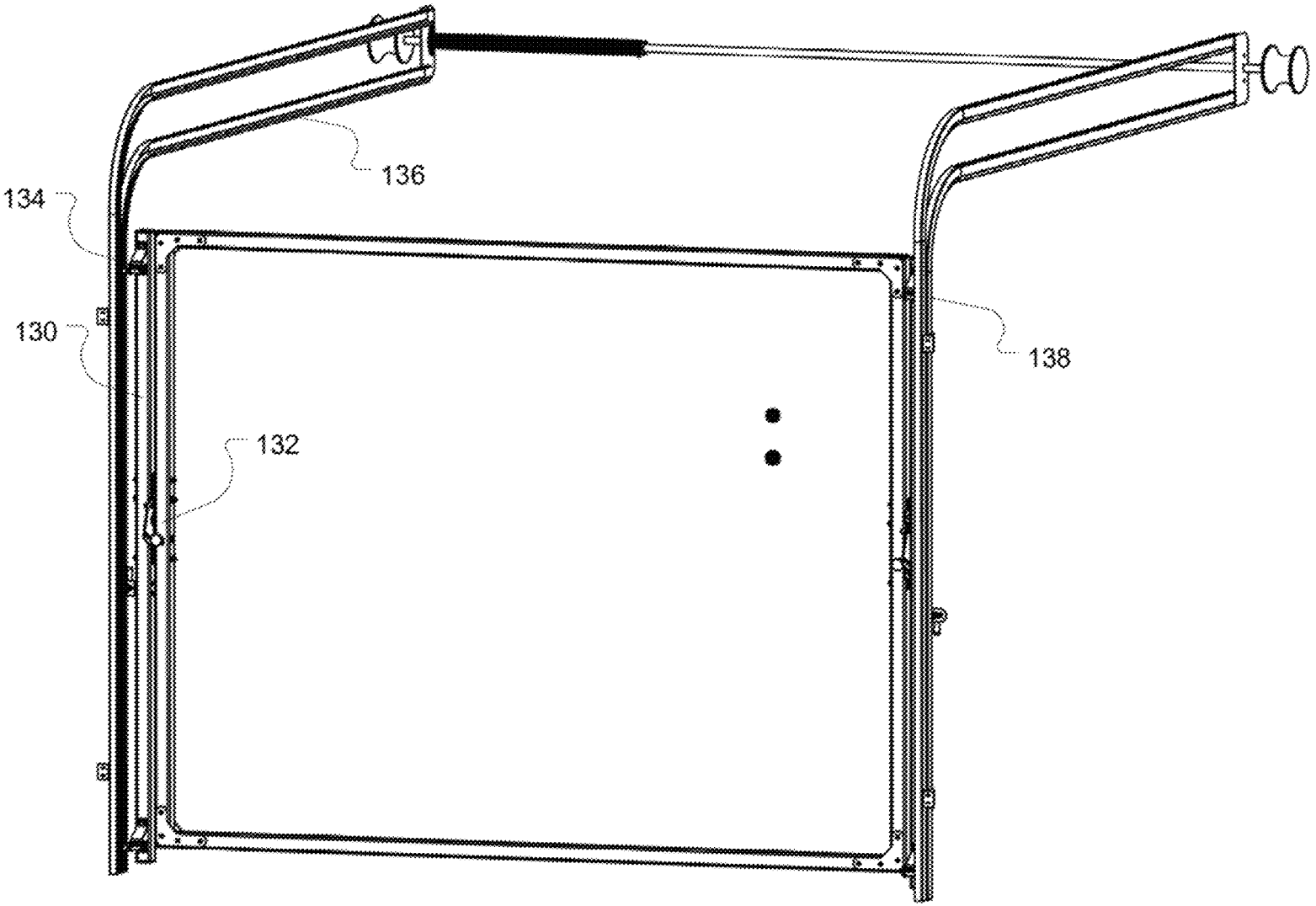
FIG. 23 shows an outside view of an embodiment of a garage sports net system.

FIG. 23 shows an outer view of another embodiment of garage net system. The net system moves up and down parallel to the garage door in horizontal rails 136 and vertical rails 138, typically by wheeled attachments called adjustable roller mounts 134, discussed in more detail later. The brackets attach the garage sports net system rails, to the wall garage door rails. The adjustable roller mounts for the garage sports net system may push the net forward to make it flush with the garage door vertical rails, but are actually roll in a second vertical and horizontal rails specifically used for the garage sports net system.

Figure 24:
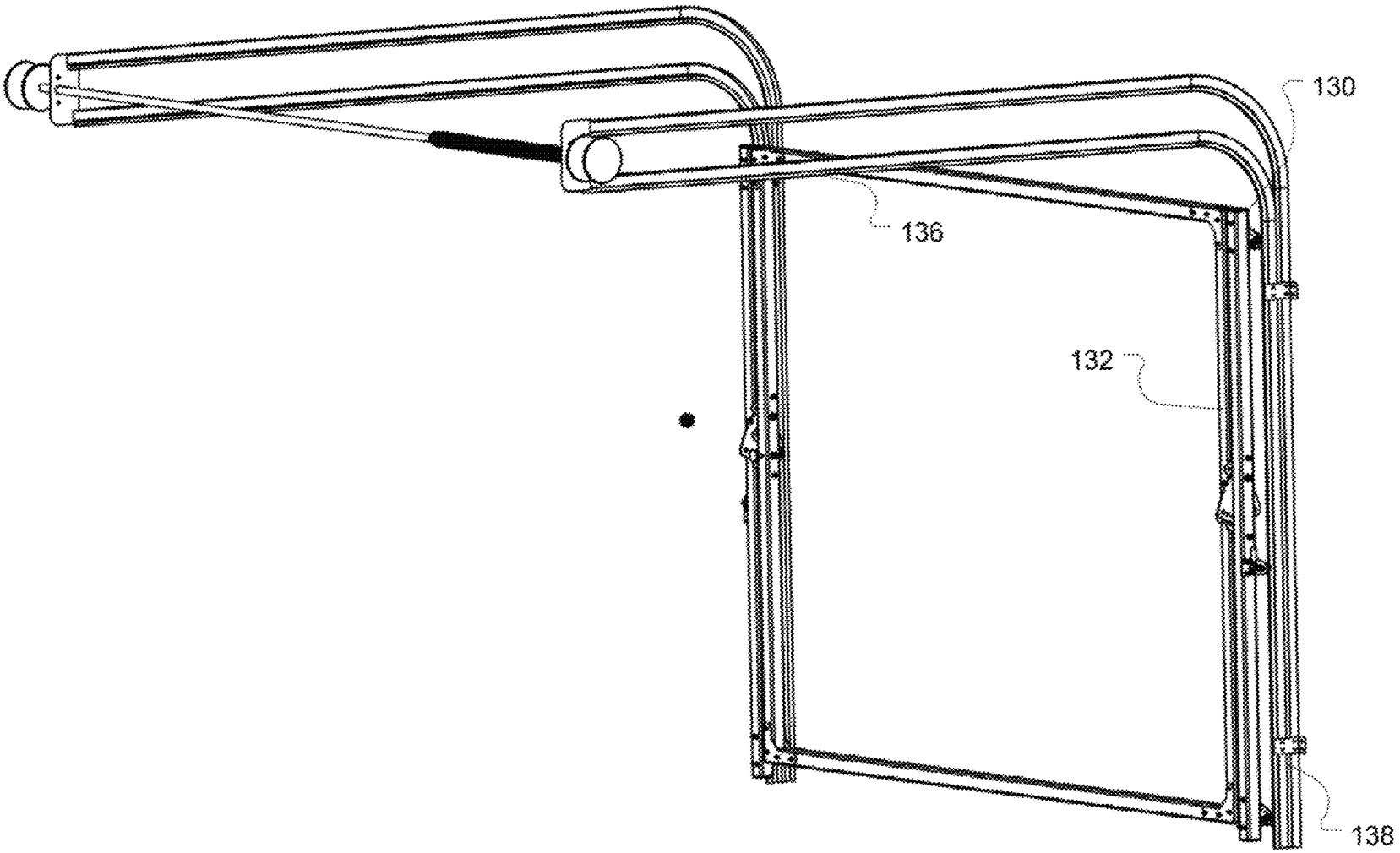
FIG. 24 shows an inside view of an embodiment of a garage sports net system.

The garage net system has two vertical tubes, 133 and 135. In this position, referred to here as the deployed position, the user can kick, throw, or hit balls, pucks or other projectiles into the net, and the net will cause the projectile to bounce back to the user at an angle determined by the angle selected by the tilt plate, or, absorb the impact of the ball using a loose impact netting. As will be discussed in more detail later, the tilt pivots and the locking tilt pivot angling attachment in this embodiment allow the net to be angled and locked into a chosen position. FIG. 24 shows an inner view of a garage net system. From this view, one has a clearer view of the net system frame 130 vertical tube 133 mated with the garage door vertical rail 138.

Figure 25:
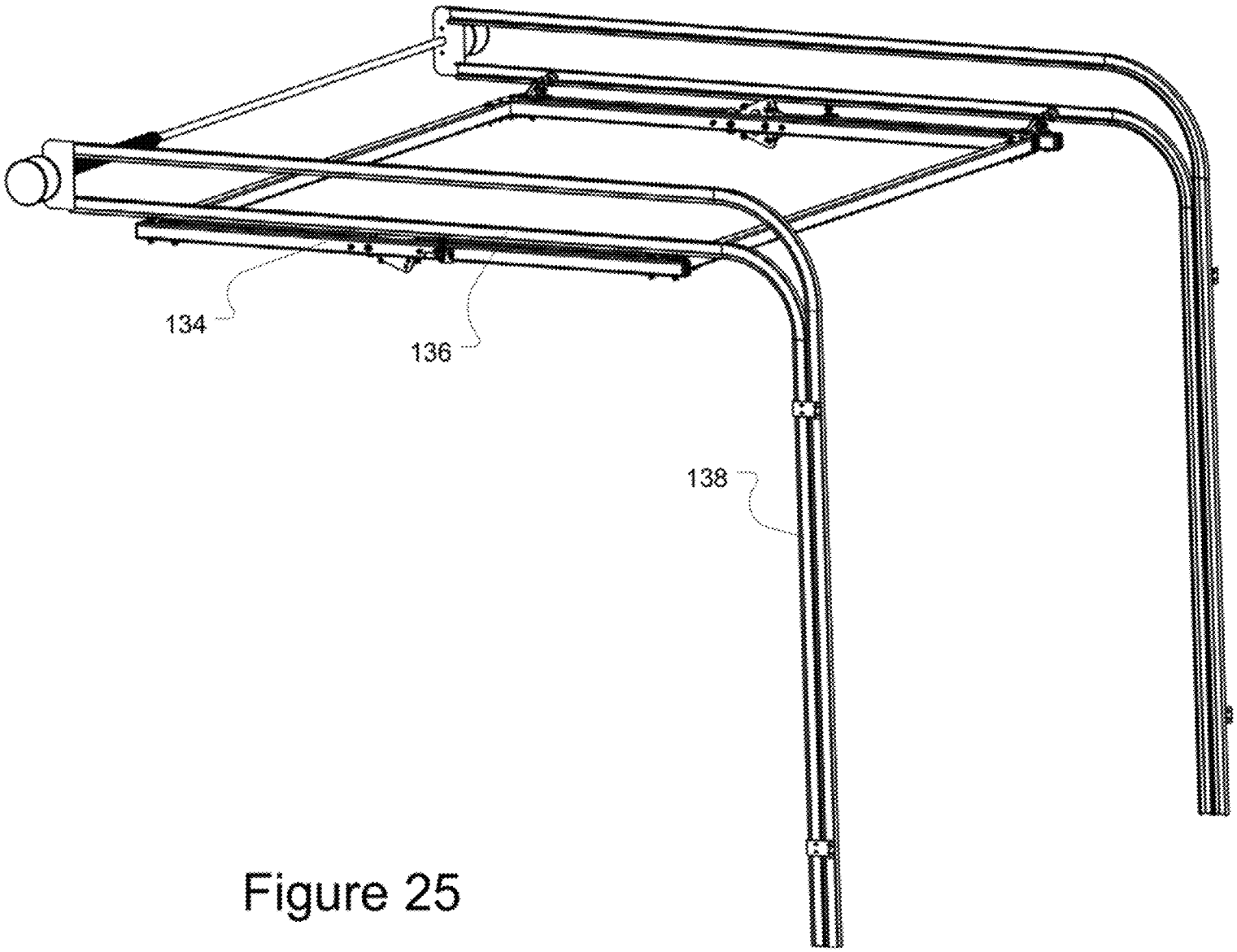
FIG. 25 shows an embodiment of a garage sports net system in a stowed position.
Figure 26:
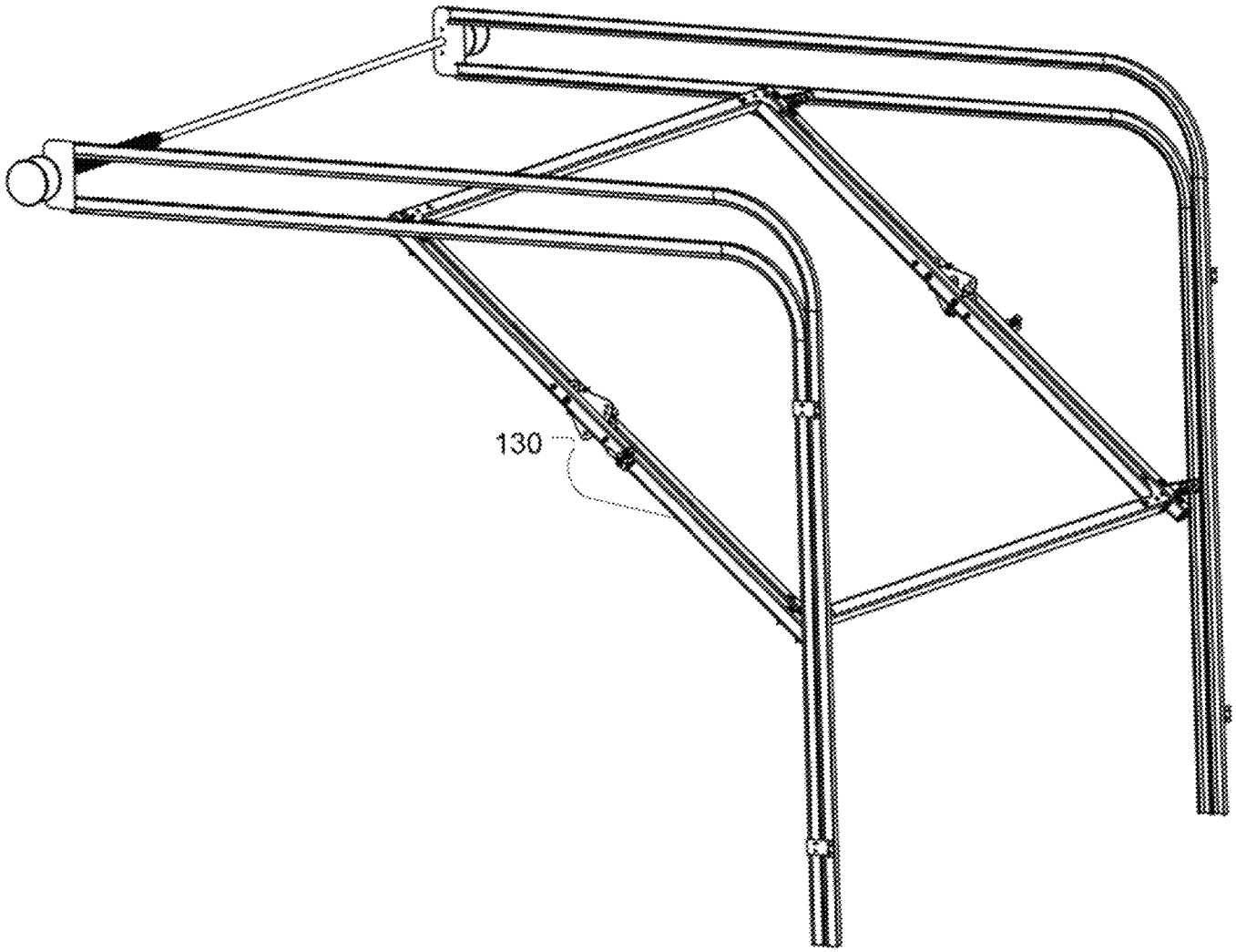
FIG. 26 shows an embodiment of a garage sports net system in a deployed position.

FIGS. 25-26 show the net as it deploys into its system for use. In FIG. 25, the net is in its stowed or un-deployed position. The net will deploy down along rail 138. FIG. 26 show the net system 130 as it reaches its deployed position.

Figure 27:
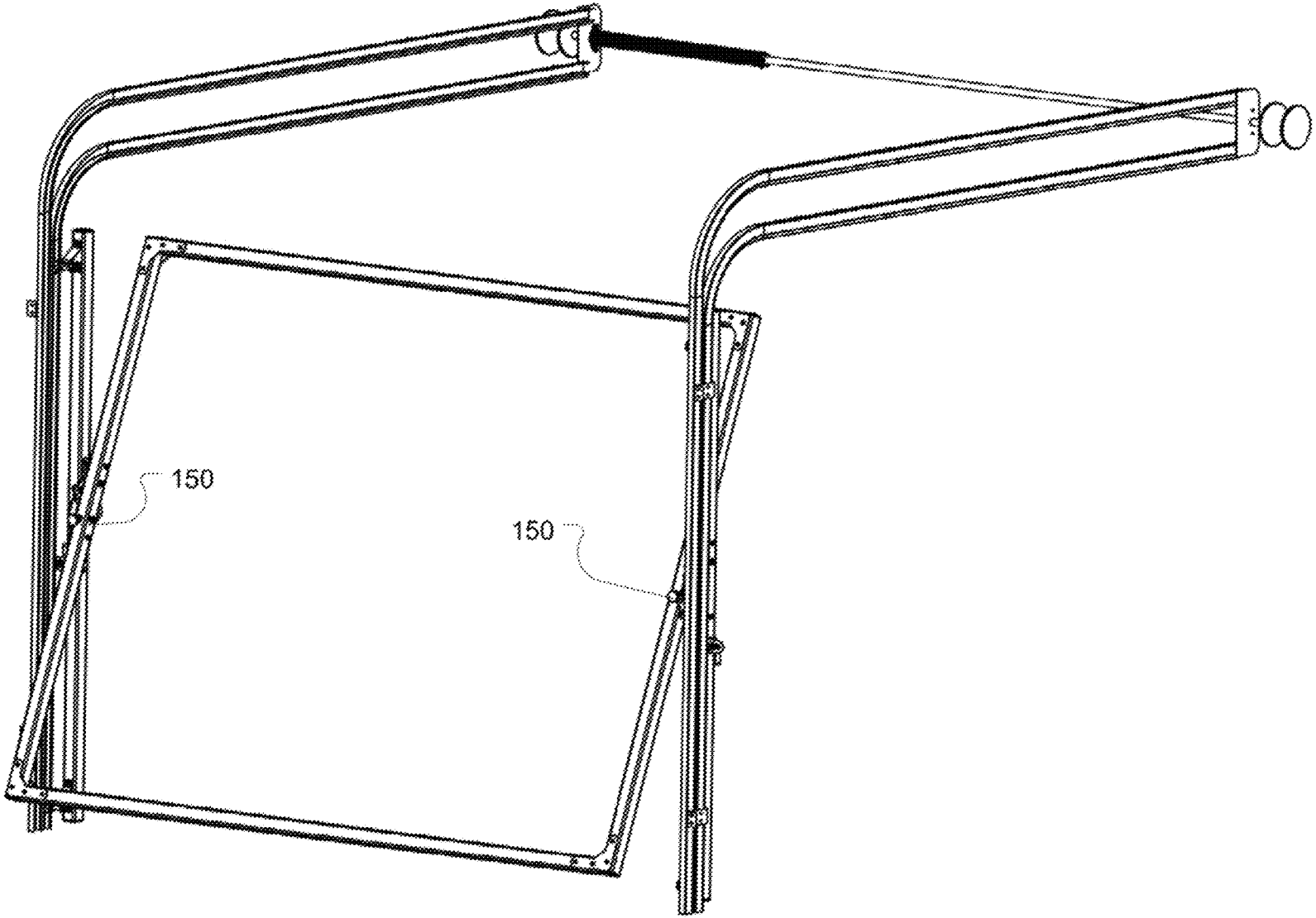
FIG. 27 shows an embodiment of a garage sports net system in a deployed position and angled out.
Figure 28:
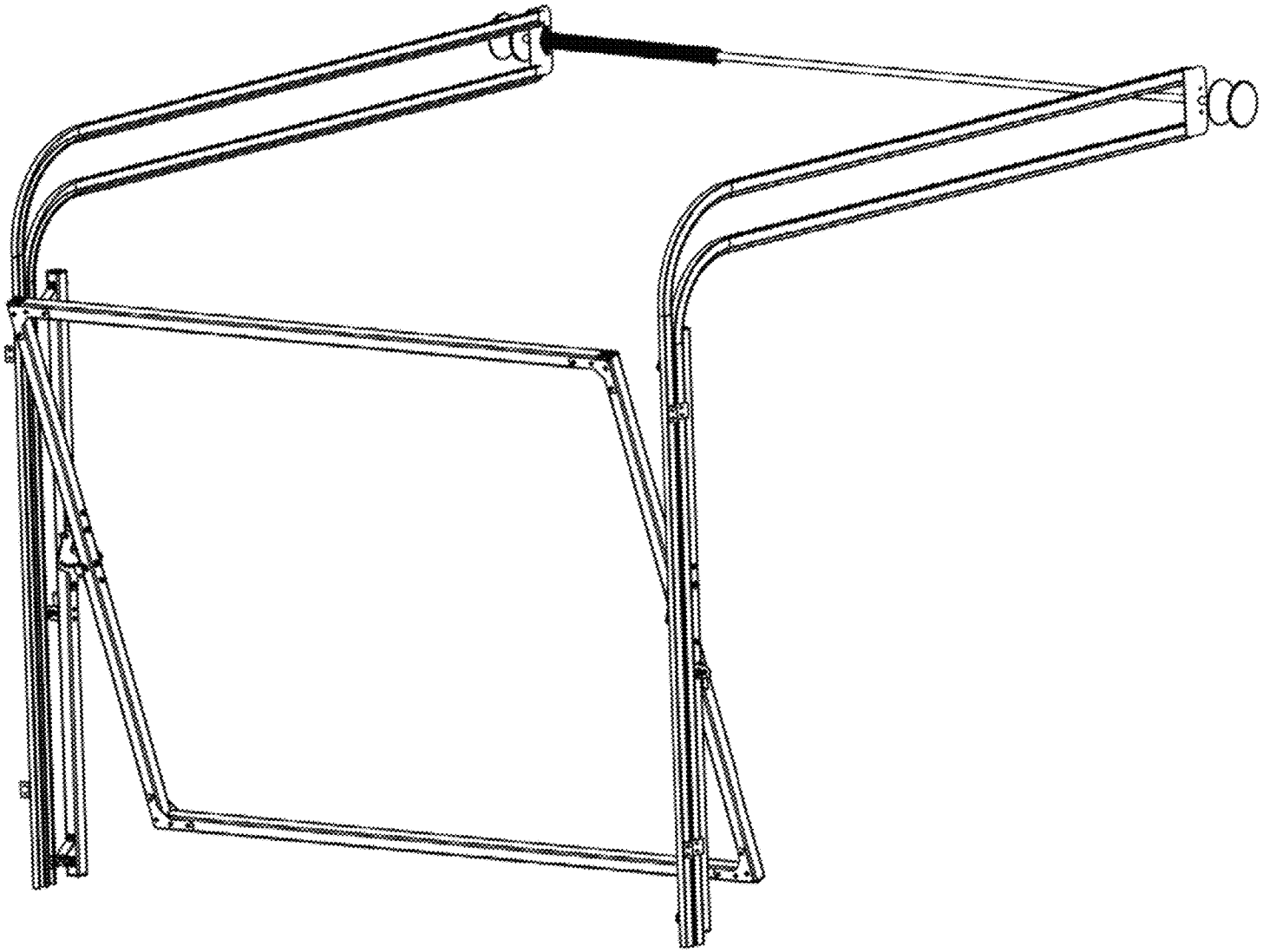
Figure 29:
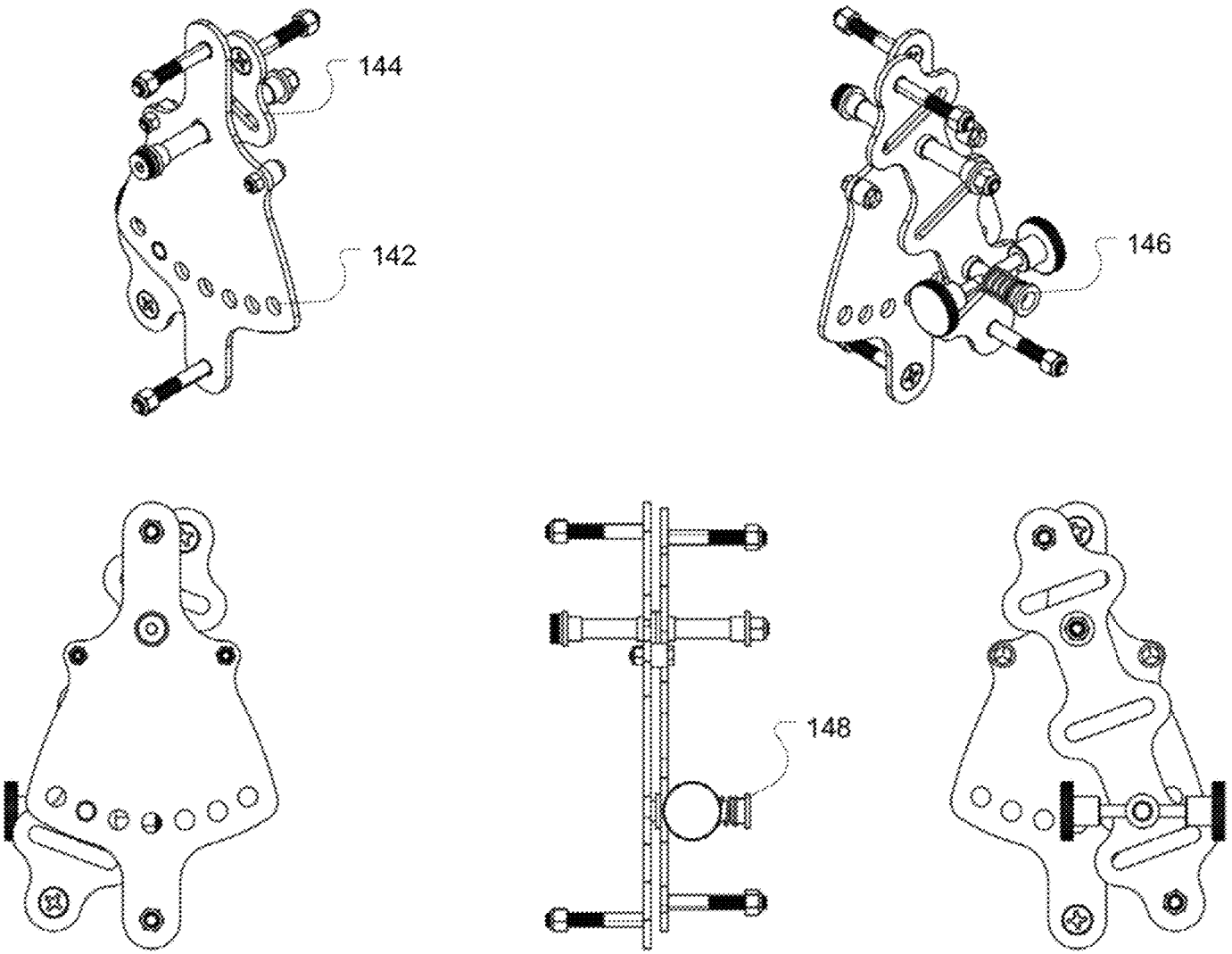
FIG. 29 shows an embodiment of a tilt plate assembly.

FIGS. 27-28 show one embodiment of an angling attachment 150, which may be referred to as a tilt pivot point assembly. In FIG. 27-28, both tilt pivot point assemblies have been adjusted to angle the net. FIG. 29 shows more detailed views of the tilt pivot point assembly having front plate 143 and back plate 144, with the view on the left being from the front plate perspective, and the one on the right being from the back plate view. Holes such as 142 in the tilt plate 143 allow the net's angle can be adjusted from 0° up to 30° in both directions from the perpendicular deployed position in 10° increments. Stops on the tilt plate restrict the net from swinging past 30° in either direction. The pin 146 is spring loaded and retracts backward away from plates to allow the plates to move relative to each other as shown in the lower left and right views.

Figure 30:
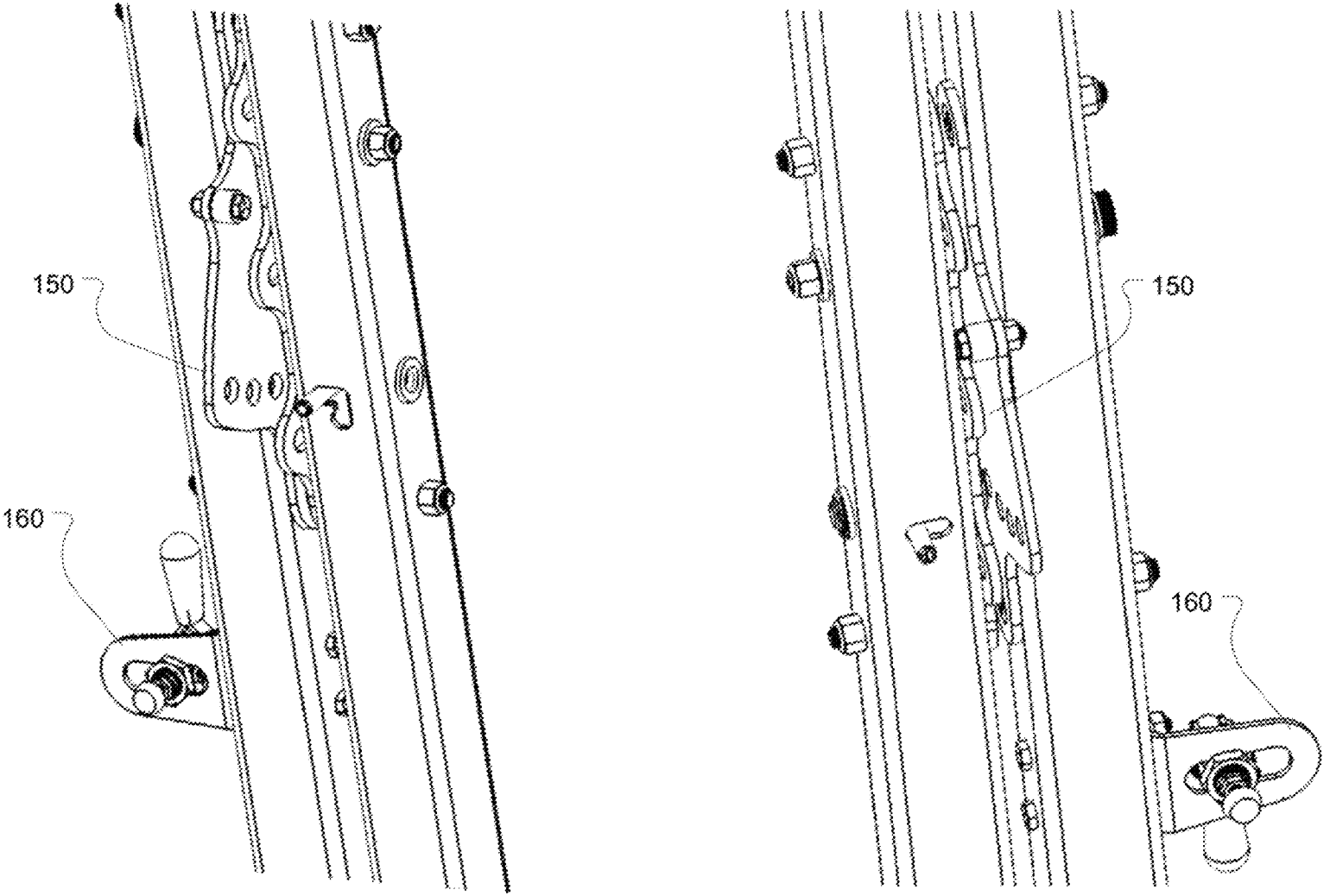
FIGS. 30-31 show an embodiment of a tilt pin and brace mount assembly.
Figure 31:
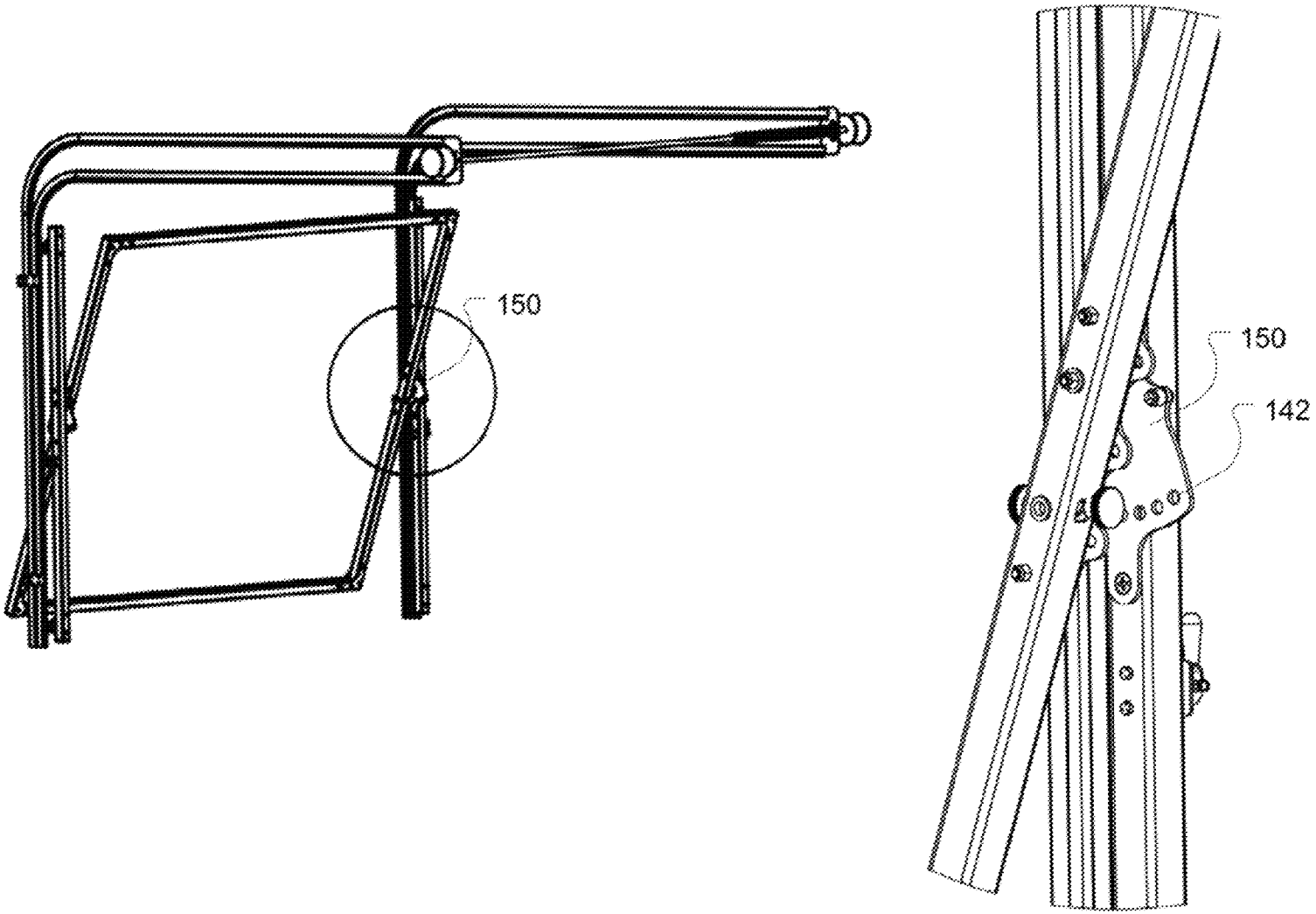

FIG. 30-31 shows a more detailed view of the tilt pivot plate assemblies attached to the tubes and the rails. Each garage sports rebounder has 2 sets of pivot plate assemblies. Each tilt plate assembly has 2 plates. The plate assemblies may be attached 5 inches above the center of the locking vertical tube, and non-locking vertical tube, so the tilting motion will not strain the frame. In FIG. 30, one can see the locking bracing mount 160 on the left and right side views of the locking tube.

Figure 32:
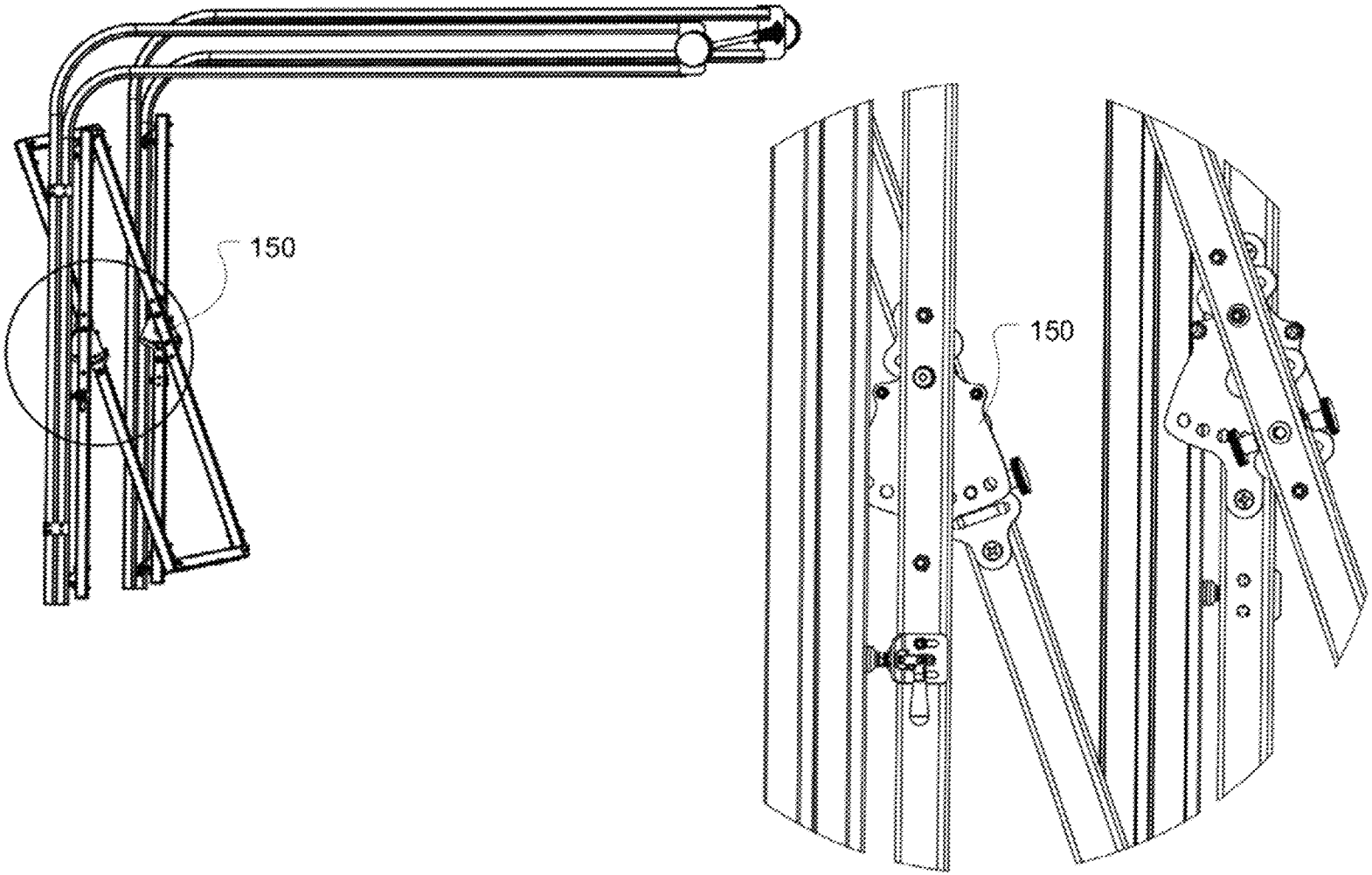
FIG. 32 shows an embodiment of a tilt pin and brace mount assembly.

Shown in FIG. 31, on the right side of the net's frame, the first tilt pivot point assembly 150 uses a spring mounted tilt pin to make an adjustment. This tilt pin does not lock into an open position. On the left side of the net's frame, shown in FIG. 32 the tilt pivot point assembly 152 uses a spring mounted tilt pin to make an adjustment to the net's angle. The tilt pin slides toward the center of the net assembly, and then down and into an open position. When the pin is in a down and open position, the user can make adjustments to the angle of the net on the first tilt pivot plate assembly. This is convenient for the operator as the angle of the net can be adjusted by a single user.

One of the plates is attached by 2 fasteners to the vertical tubes of the net frame of the garage sports rebounder. This plate has 3 horizontal slots that are spaced at even increments to allow for a net to attach to the frame of the garage sports rebounding frame, without interfering with the operation of the tilt plate mechanism.

Both plates in the tilt plate assembly have corresponding ⅝" holes that are fit with bushings. The shoulder bolt is the pivot point for the garage sports rebounding assembly as it runs through the vertical support tube, the pivot plate assemblies, the spacers, and the vertical net frame tube.

In three easy steps, the angle of the net can be changed. First, an operator would move the spring loaded locking pin into an open position. Second, an operator would adjust the angle of the net moving the spring loaded tilt pin and anchor it into an angling hole. Third, the operator would move the tilt spring loaded locking pin from the open position, locking it into one of the angling holes. The pins have a handles that allow the user to move the locking pin and the tilt pin.

Figure 33:
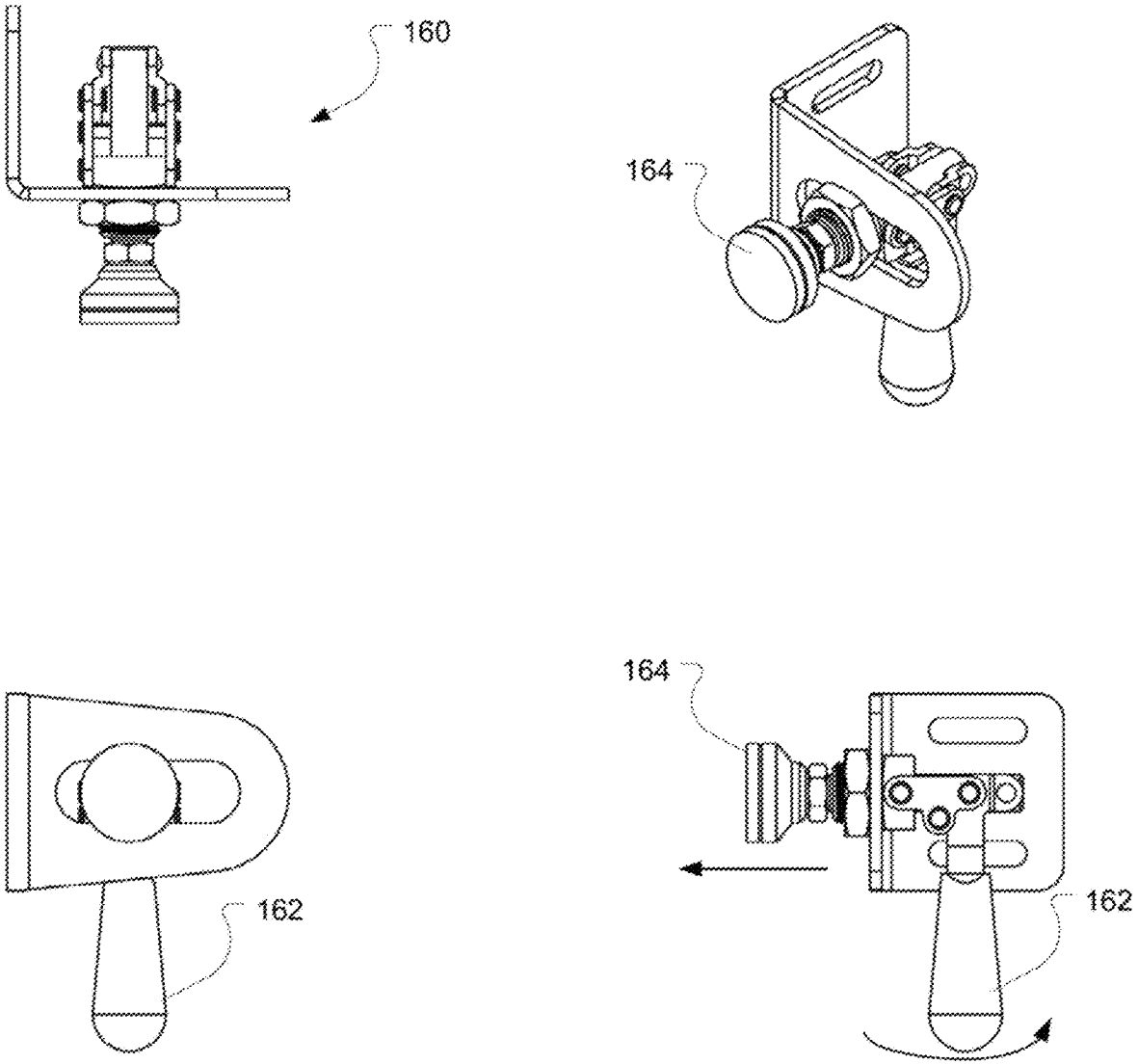
FIG. 33 shows an embodiment of a bracing mount.

FIG. 33 shows a more detailed view of a bracing mount and bracing lever. The bracing mounts and levers strengthen the connection between the wall and the rail, limits the frame movement, and assists with the absorption of the impact of various projectiles on the frame. On the garage sports net system, there are at least 2 bracing mounts 160. The bracing mount is attached to the support tubes by four fasteners. The push/pull-action, hole mounted toggle clamp 160 is joined with a holding screw and rubber stopper, through a slot in the bracing mount. The position of the toggle clamp and holding screw is locked into place using a tightening nut. The slot in the bracing mount allows adjustment for the toggle clamp and holding screw so that it can be aligned with the garage sports rebounding rails. The holding screws length can also be adjusted to ensure proper fit and bracing in the open position. The clamp has a built-in lock/release lever to prevent accidental opening in high vibration applications.

Using a handle 162, the lever is grasped and pulled up in the direction of the arrow in the lower right corner. This moves the stopper 164 forward towards the garage sports net system rail, causing the stopper to brace against the rail. Using the handle, the lever is grasped and pulled up in the direction of the arrow which moves the foot backwards and away from the garage sports net system rail, causing the foot to become loose, and to lose the connection with the rail.

Figure 34:
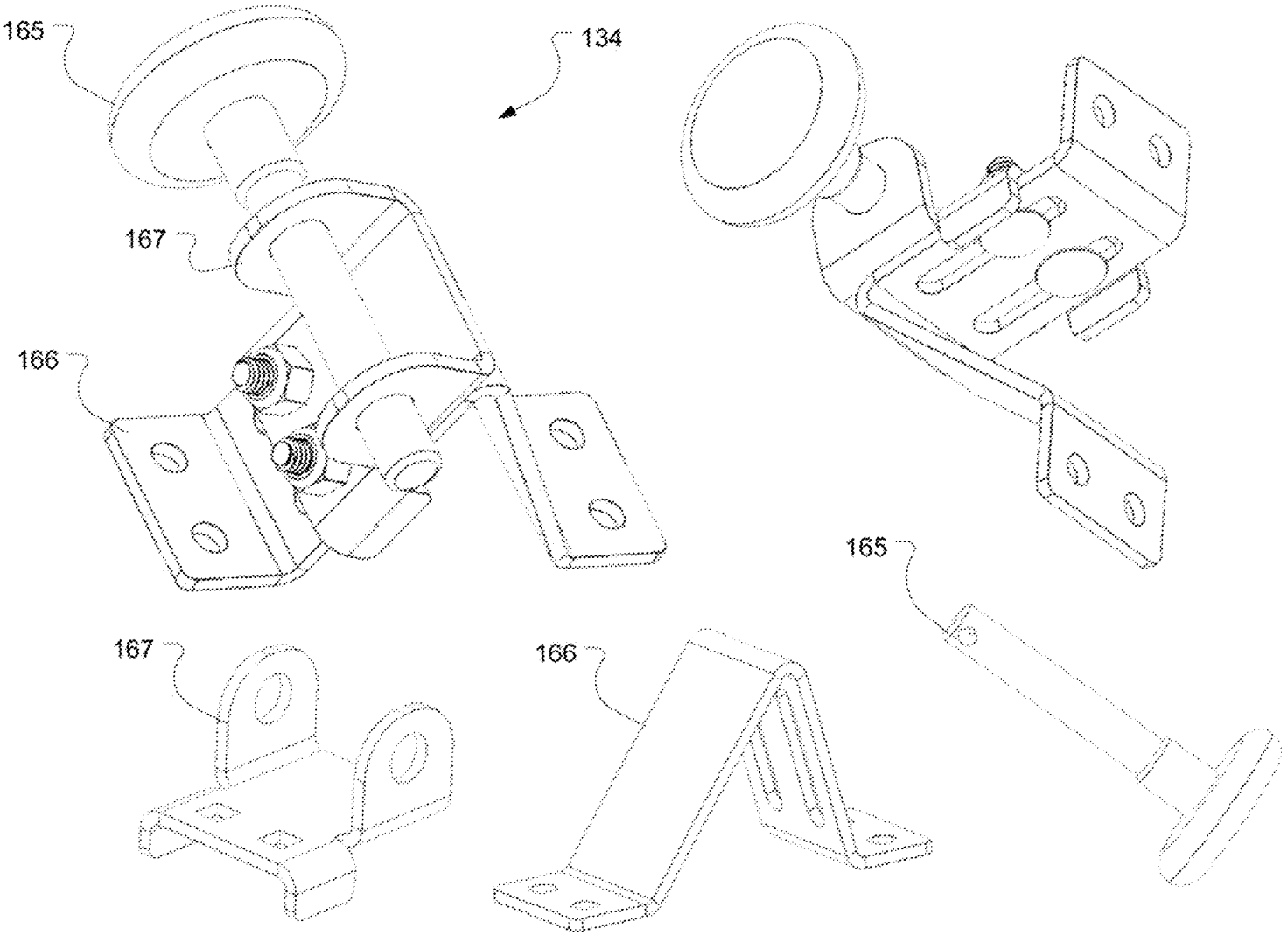
FIG. 34 shows an embodiment of a roller mount.

The stem of the roller is modified to include a small hole to prevent the stem from coming out of the roller bracket. FIG. 34 shows a more detailed view of a roller mount. The roller mount 166 is attached to the support tubes by four fasters. The mounting bracket 167 is attached to the roller bracket by 2 carriage bolts and 2 nuts. The garage door roller 165 slides through the two wings of the mounting bracket 167 and is locked into place using a small bolt and locking nut not shown. The mounting bracket 167 has the ability to have its position on the roller bracket adjusted up and down the sliding slots to accommodate for variations in garage door width. The garage door roller allows for the garage sports net system to travel on the garage door rail in the same manner of a traditional garage door.

Figure 35:
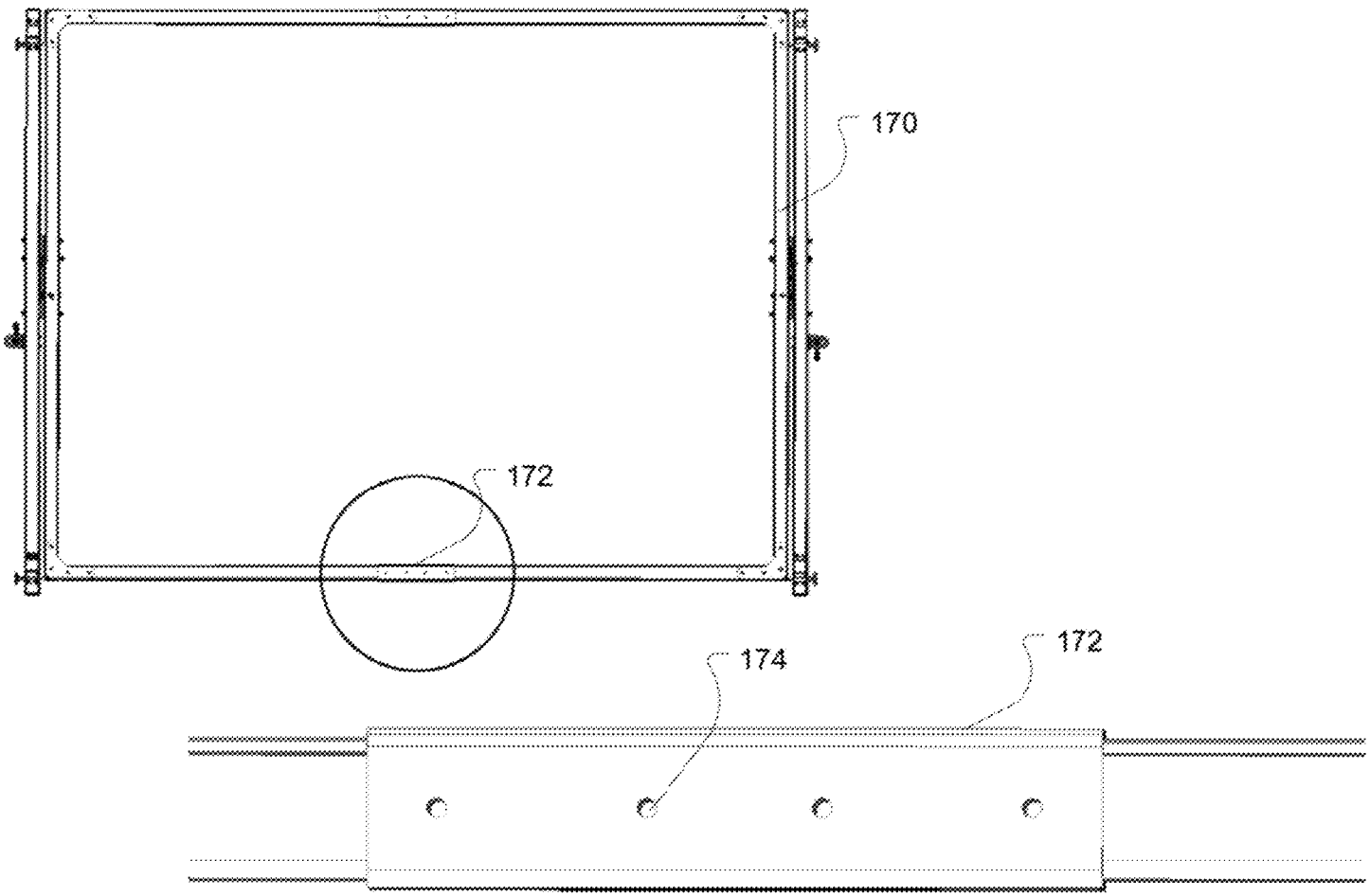
FIG. 35 shows an embodiment of an expandable garage door frame.

FIG. 35 shows how the frame can expand to be wider to accommodate for a slightly wider garage. This would be helpful because shipping a tube that is as wide as a garage door would be inconvenient and expensive. In the embodiment of FIG. 35, the inner frame 170 can be expanded by the sleeve 172. The sleeve 172 has fasteners such as the holes 174 which would mate with a pin of some sort, to allow the frame to slide out from either side of the sleeve to make the overall frame wider. This would allow accommodation of wider garage doors, or even to allow the frame to be made smaller for shipping.

Many different modifications and variations are possible. The material used for the frame may vary depending upon the application. Typically, the tubes will be made out of aluminum, as it is strong and light. For example, the tubes may consist of steel. It is stronger and heavier, but may have issues with rust. Different sizes of the aluminum piping may be used, smaller diameters may be lighter, cost less to ship and take up less room.

Other variations may include increasing the spacing between the vertical tubes. This may allow for a longer stem for the wheels. In some embodiments, the stem does not have a traditional length of sliding movement as you would find in a traditional garage door. Another variation may involve using something besides bungees to attach the net to the frame, including adjustable nylon tension straps, lacing chords for impact netting, hook and loop such as Velcro®, among other options.

Figure 36:
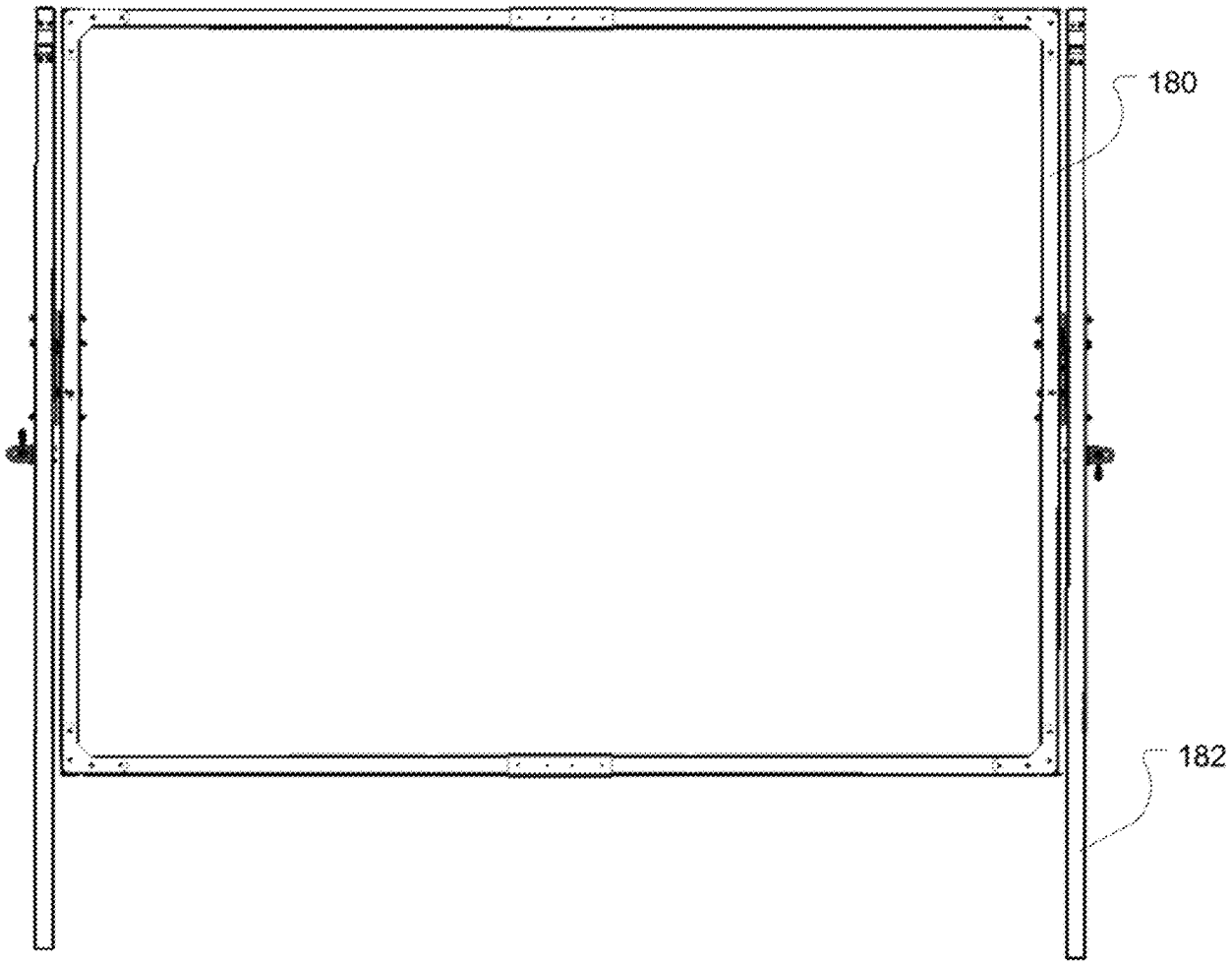
FIG. 36 shows an embodiment of a ground mounted net system.

FIG. 36 shows another variation. Instead of being mounted on a garage door, the frame could be mounted directly to the ground. The net rails in which the vertical tubes moved move instead inside support rails such as 182, which extend some distance beyond the bottom of the frame 180. These support rails may mount into a gym floor via a metal sleeve, similar to volleyball net standards that have a lid. The lid is closed and flush with the floor when not needed and then lifted and the rails inserted. Alternatively, the ends of the rails may be spiked to allow them to be driven into the ground, or permanently ground mounted into concrete. Instead of the sleeves being in a floor, they could be in the ground also with a lid to keep water and dirt out. The rails, whether inserted into a sleeve, or driven directly into the ground, will be referred to as ground-mountable.

Other components may be added to the system. The may include an additional bracing as a brace on the vertical support, above the pivot point, in order to increase the stability of the wall. Additionally, a safety latch may prevent the wall from changing angles. In addition to adding some components, other components may be removed, such as removing the slotted plate. The frame may be assembled to the wall in different ways to allow for easier shipping and distribution.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art, which are also intended to be encompassed by the discussion of the above embodiments and the following claims.

What is claimed is:

1. A sports net system, comprising:

a frame attached to rails of a garage door by a second set of rails, the frame having vertical tubes that are movable within the second set of rails;

a sports net attached to the frame;

pivots attached to the frame on either side, each pivot comprising two pieces configured to move relative to each other to tilt the frame, a first piece having a set of holes that correspond to different positions of the frame relative to the rails, and a second piece having a pin configured to insert into the holes, the pivots positioned on the frame such that the frame can move within the second set of rails when the pivots are in a neutral position; and a bracing mount attached to the tubes to strengthen a connection between the frame and the second set of rails by a handle and stopper, wherein the handle controls the position of the stopper.

2. The sports net system of claim 1, the frame having top and bottom rails.

3. The sports net system of claim 2, the top and bottom rails having sleeves, the top and bottom rails movable inside the sleeve to expand and collapse to match a width of the garage door.

4. The sports net system of claim 1, wherein the pivots comprise:

a tilt plate as the first piece;

a spring loaded tilt pin on the second piece;

holes in tilt plate configured to receive the tilt pin.

5. The sports net system of claim 4, wherein the holes are arranged to tilt the frame in ten degree increments.

6. The sports net system of claim 4, wherein the holes are arranged to allow the frame to tilt in front of the rails of the garage door, and behind of the rails of the garage door.

7. The sports net system of claim 4, wherein the spring loaded tilt pin further comprises a spring loaded locking pin.

8. The sports net system of claim 7, wherein the spring loaded locking pin is retractable.

9. The sports net system of claim 4, further comprising at least one stop on the tilt plate positioned to stop the frame from tilting beyond a predetermined point.

10. The sports net system of claim 4, further comprising a handle to allow a user to position a bottom rail of the frame in a tilted position.

11. The sports net system of claim 1, wherein the frame comprises one of aluminum or steel.

12. The sports net system of claim 1, wherein the sports net comprises one of an impact netting or rebound netting.

13. The sports net system of claim 1, wherein the sports net is attached to the frame with one of bungees, hook and look closures, lacing chords, and nylon tension straps.

* * * * *